US012043989B2

(12) United States Patent
Roh et al.

(10) Patent No.: US 12,043,989 B2
(45) Date of Patent: Jul. 23, 2024

(54) WORKING MACHINE

(71) Applicant: HITACHI CONSTRUCTION MACHINERY CO., LTD., Tokyo (JP)

(72) Inventors: Joonyoung Roh, Ibaraki (JP); Hiroshi Sakamoto, Chiba (JP); Youhei Toriyama, Chiba (JP); Naoki Hayakawa, Ibaraki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 404 days.

(21) Appl. No.: 17/436,431

(22) PCT Filed: Sep. 18, 2020

(86) PCT No.: PCT/JP2020/035518
§ 371 (c)(1),
(2) Date: Sep. 3, 2021

(87) PCT Pub. No.: WO2021/060195
PCT Pub. Date: Apr. 1, 2021

(65) Prior Publication Data

US 2022/0170243 A1 Jun. 2, 2022

(30) Foreign Application Priority Data

Sep. 25, 2019 (JP) ..... 2019-174615

(51) Int. Cl.
*E02F 9/26* (2006.01)
*E02F 9/22* (2006.01)

(52) U.S. Cl.
CPC ..... *E02F 9/262* (2013.01); *E02F 9/2228* (2013.01); *E02F 9/265* (2013.01)

(58) Field of Classification Search
None
See application file for complete search history.

(56) References Cited

U.S. PATENT DOCUMENTS 11,236,492 B1 * 2/2022 Ready-Campbell .... E02F 9/267
2009/0202109 A1 8/2009 Clar et al.
(Continued)

FOREIGN PATENT DOCUMENTS

CN 107923745 A 4/2018
CN 108691325 A 10/2018
(Continued)

OTHER PUBLICATIONS

Chinese Office Action received in corresponding Chinese Application No. 202080018342.X dated May 7, 2022.
(Continued)

*Primary Examiner* — Peter D Nolan
*Assistant Examiner* — Jacob Kent Besteman-Street
(74) *Attorney, Agent, or Firm* — MATTINGLY & MALUR, PC

(57) ABSTRACT

A working machine 1 includes a design data obtainment unit 29, a topography measuring device 30, and a controller 21. The controller 21 extracts peripheral area shape data from the design data in the construction-site coordinate system, maps similar shape portions between the extracted peripheral area shape data and the current topography data in the current topography coordinate system, calculates a coordinate transformation matrix to transform from the current topography coordinate system to the construction-site coordinate system so that a difference in coordinate values of the mapped shape portions is minimized, and transforms the self-position and posture of the working machine 1 and the current topography data from coordinates in the current topography coordinate system to coordinates in the construction-site coordinate system using the calculated coordinate transformation matrix.

3 Claims, 26 Drawing Sheets

(56) References Cited

U.S. PATENT DOCUMENTS

| | | | | |
|---|---|---|---|---|
| 2016/0321763 | A1* | 11/2016 | Shike | G06Q 50/08 |
| 2018/0182120 | A1* | 6/2018 | Izumikawa | G01C 7/04 |
| 2018/0282977 | A1 | 10/2018 | Hiromatsu et al. | |
| 2019/0360174 | A1* | 11/2019 | Kawamoto | G01S 5/163 |
| 2020/0032483 | A1* | 1/2020 | Ready-Campbell | G05D 1/0274 |
| 2020/0273191 | A1 | 8/2020 | Izumikawa | |
| 2021/0149391 | A1* | 5/2021 | Ready-Campbell | G05D 1/0289 |
| 2021/0238828 | A1* | 8/2021 | Takahama | E02F 9/26 |
| 2021/0285184 | A1* | 9/2021 | Tanimoto | E02F 9/262 |
| 2022/0070611 | A1* | 3/2022 | Ready-Campbell | G08G 1/0968 |

FOREIGN PATENT DOCUMENTS

| | | | |
|---|---|---|---|
| JP | 2002-328022 | A | 11/2002 |
| JP | 2011-514455 | A | 5/2011 |
| JP | 2016-212469 | A | 12/2016 |
| JP | 2018-146594 | A | 9/2018 |
| JP | 2019-159727 | A | 9/2019 |
| WO | 2018-079789 | A1 | 5/2018 |

OTHER PUBLICATIONS

International Search Report of PCT/JP2020/035518 dated Dec. 8, 2020.

* cited by examiner

WORKING MACHINE

TECHNICAL FIELD

The present invention relates to a working machine, and particularly relates to a working machine that measures the current topography of a construction site for computerization construction and estimates the self-position and posture.

The present application claims priority from Japanese patent application No. 2019-174615 filed on Sep. 25, 2019, the entire content of which is hereby incorporated by reference into this application.

BACKGROUND ART

At construction sites, computerization construction utilizing information and communication technology is widely used for the purpose of solving the short staffing due to the declining birthrate and improving the production efficiency. During the process of computerization construction, a three-dimensional (3D) finished work at the construction site may be managed for the progress and quality management of the construction. To manage the 3D finished work, the measurement of the 3D finished work is required. To this end, the measurement technology using an unmanned aerial vehicle (UAV) and a total station (TS) also has been developed. To measure the three-dimensional shape at the construction site more frequently, the technology for making the working machine measure the three-dimensional finished work surrounding it has also progressed.

Patent Literature 1 describes a working machine, to which a stereo camera is attached to the swing body, to take images intermittently while swinging. The working machine then estimates the swing angle of the swing body in each of the captured images, and based on the estimated swing angle, creates a three-dimensional synthesized shape surrounding the machine to measure the three-dimensional shape surrounding the working machine.

CITATION LIST

Patent Literature

Patent Literature 1: WO 2018/079789

SUMMARY OF INVENTION

Technical Problem

To manage a 3D finished work as described above, a 3D finished work in the construction-site coordinate system is necessary. To this end, the working machine of Patent Literature 1 measures the coordinate values of the working machine in the construction-site coordinate system using a global navigation satellite system (GNSS) antenna based on satellite positioning such as GNSS, and transforms the surrounding 3D shape measured by the working machine to a 3D shape in the construction-site coordinate system.

The transformation of data using the GNSS antenna, however, requires coordinate values in the geographic coordinate system consisting of the latitude, the longitude, and the ellipsoidal height, and a coordinate transformation parameter to transform the coordinate values in the geographic coordinate system into the coordinate values in the construction-site coordinate system. To find the coordinate transformation parameter, localization (position measurement) is necessary, which is a job of measuring the coordinate values in the geographic coordinate system of the known points set at the construction site having the known coordinate values in the construction-site coordinate system. To this end, it is necessary for the operator to visit the construction site, place markers, and measure the coordinate values of the markers in the geographic coordinate system using TS or GNSS. This generates man-hours.

In view of the above problems, the present invention aims to provide a working machine capable of measuring the self-position and posture of the working machine in a construction-site coordinate system and the surrounding topographical shape, while having less man-hours required for localization.

Solution to Problem

A working machine according to the present invention includes: a traveling body that travels; a swing body mounted to the traveling body to be swingable; a working front mounted to the swing body to be rotatable; a design data obtainment unit configured to obtain design data that has topographical data after completion of construction in the form of three-dimensional data; a topography measuring device configured to measure surrounding topographical data in the form of three-dimensional data; and a controller having a design data processor configured to process the topographical data obtained by the design data obtainment unit as a predetermined first coordinate system design data, a current topography data generator configured to generate current topography data of the second coordinate system from the topography data measured by the topography measuring device, the second coordinate system being defined based on the installation position of the topography measuring device, and a position/posture estimation unit configured to estimate a self-position and posture in the second coordinate system based on the current topography data generated by the current topography data generator. The controller is configured to extract peripheral area shape data from the first coordinate system design data, map similar shape portions between the extracted peripheral area shape data and the current topography data, calculate a coordinate transformation matrix to transform from the second coordinate system to the first coordinate system so that the difference in coordinate values of the mapped shape portions is minimized, and transform the self-position and posture of the working machine and the current topography data from coordinates in the second coordinate system to coordinates in the first coordinate system using the calculated coordinate transformation matrix.

Advantageous Effects of Invention

The present invention measures the self-position and posture of the working machine in a construction-site coordinate system and the surrounding topographical shape, while having less man-hours required for localization.

DESCRIPTION OF EMBODIMENTS

The following describes some embodiments of the working machine according to the present invention, with reference to the drawings. In the following descriptions, upper, lower, left, right, front and rear directions and positions are based on the typical operating state of the working machine, i.e., when the traveling body of the working machine comes in contact with the ground.

First Embodiment

Figure 1:
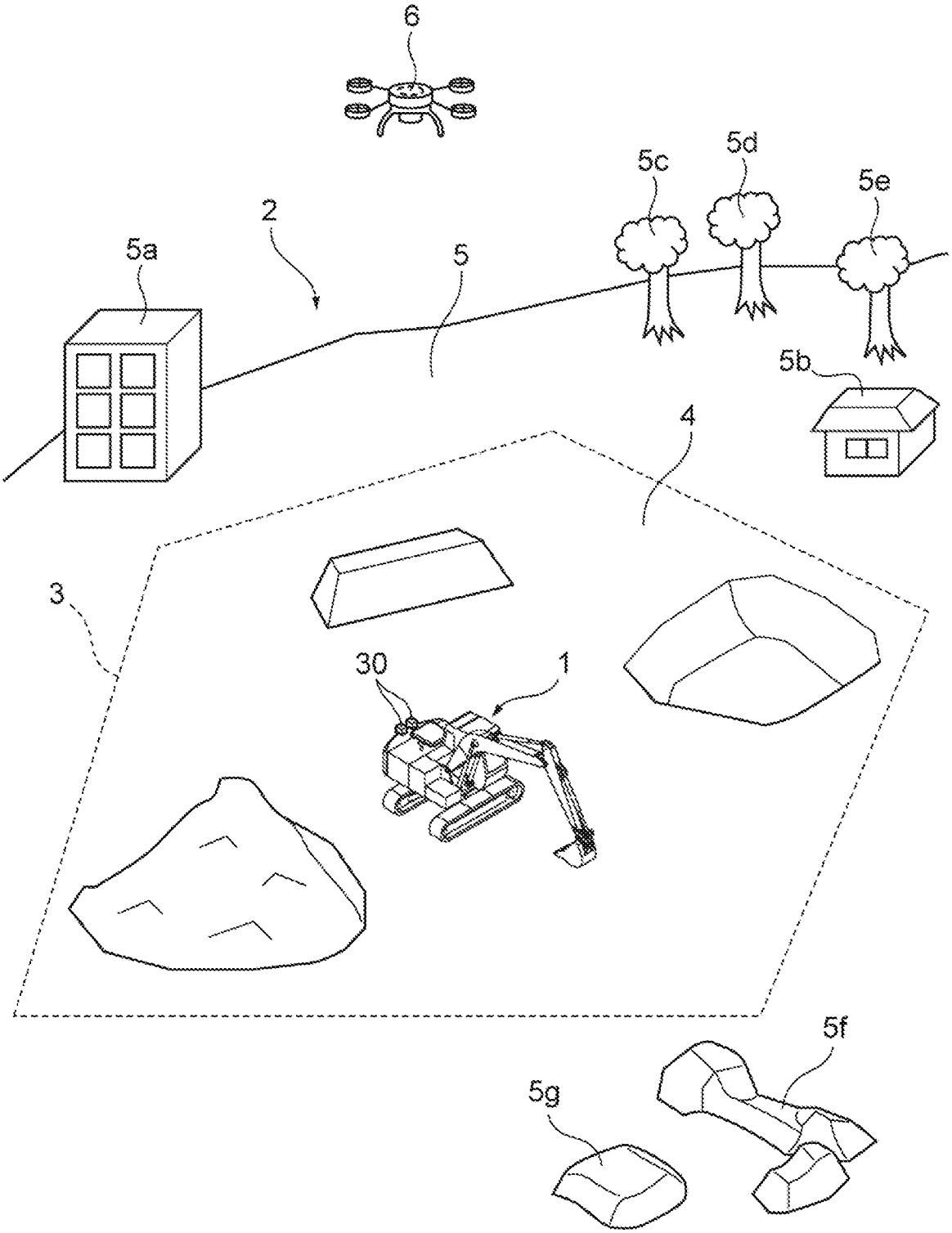
FIG. 1 schematically shows a worksite in which a working machine of a first embodiment operates.

Referring to FIG. 1, the following describes a worksite where the working machine according to a first embodiment operates. As shown in FIG. 1, the worksite includes a working machine 1 that performs computerization construction to a construction target 2, and an unmanned aerial vehicle (UAV) 6 that measures the shape of the construction target 2 while flying over the construction target 2 to measure at the start of construction for survey.

The construction target 2 has a construction boundary 3. The working machine 1 performs construction jobs, including excavation, embankment, and slope shaping to the construction target 2 so that the construction target 2 has a shape according to predetermined design data in the construction area 4 surrounded by the construction boundary 3. A peripheral area 5 surrounds the construction area 4. The peripheral area 5 includes buildings 5*a*, 5*b*, natural objects 5*c*, 5*d*, 5*e*, and topographical features 5*f*, 5*g*. The working machine 1 does not perform construction in the peripheral area 5 outside of the construction boundary 3, and the shape of the peripheral area 5 does not change by the construction work of the working machine 1.

For computerization construction, various functions are used, including a machine control function of inputting the design data having data on a shape of the construction target 2 after the completion of the construction to a controller 21 (described later) of the working machine 1 and controlling the working machine 1 so that the bucket tip moves along the target construction face set based on the design data, and a finished work management function of measuring the current topography of the construction area 4 using a topography measuring device 30 (described later) installed in the working machine 1 to manage the finished work of the construction area 4.

Figure 2:
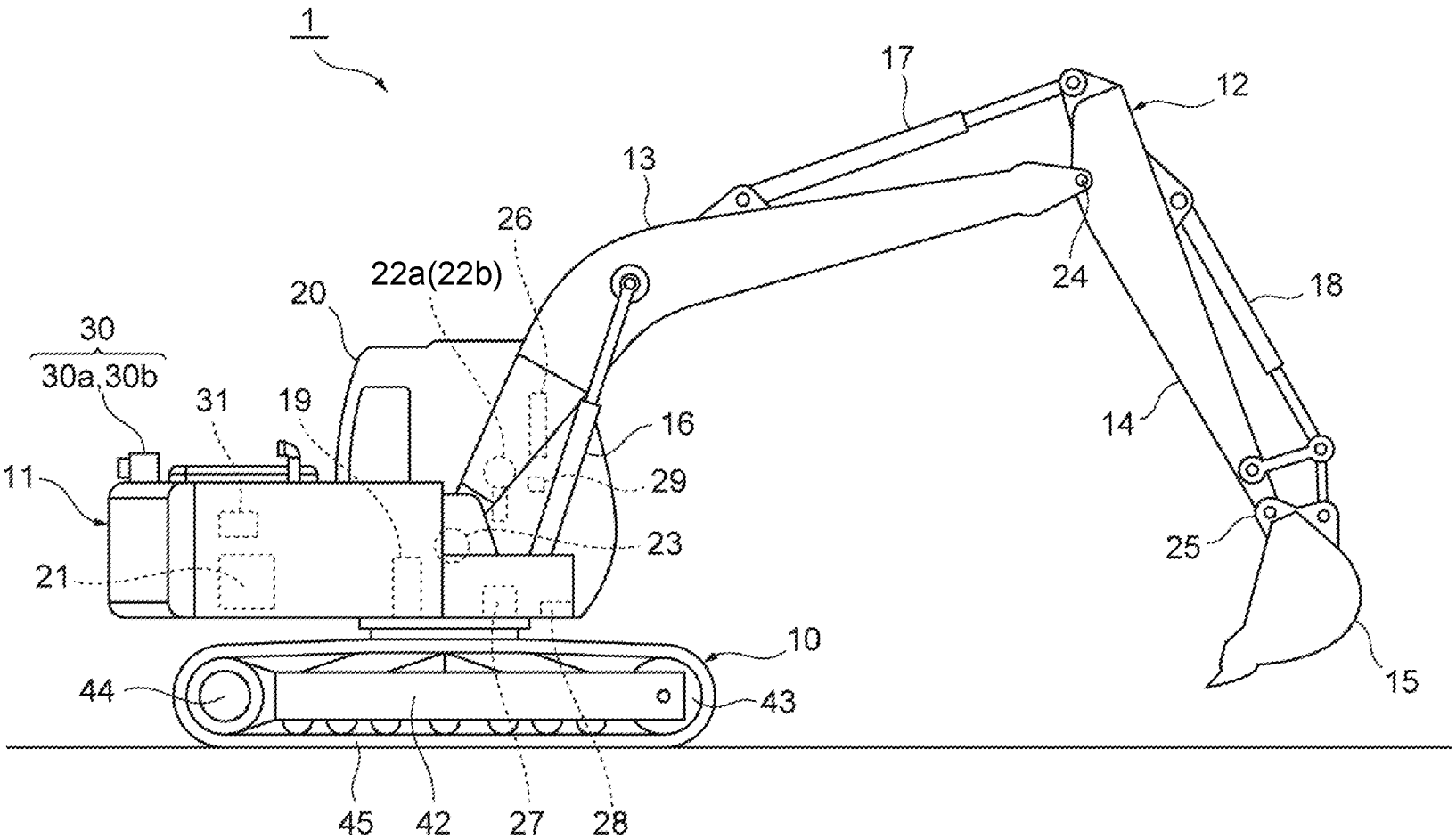
FIG. 2 is a side view showing the configuration of a working machine according to the first embodiment.

FIG. 2 is a side view showing the configuration of a working machine according to a first embodiment. In one example, the working machine 1 according to the present embodiment is a hydraulic excavator, including a traveling body 10 that can travel, a swing body 11 that swings to the left and right relative to the traveling body 10, and a working front 12 that turns up and down relative to the swing body 11.

The traveling body 10 is placed at a lower part of the working machine 1, and includes a track frame 42, a front idler 43, a sprocket 44, and a track 45. The front idler 43 and the sprocket 44 are disposed on the track frame 42, and the track 45 goes around the track frame 42 via those components.

The swing body 11 is disposed above the traveling body 10. The swing body 11 includes a swing motor 19 for swinging, a cab 20 in which an operator is seated to operate the working machine 1, a controller 21 that controls the operation of the working machine 1, operation levers 22*a* and 22*b* in the cab 20, a display device 26 in the cab 20 to display the body information of the working machine 1, and a design data obtainment unit 29 in the cab 20 to obtain design data in the form of three-dimensional data.

The swing body 11 includes a swing gyroscope 27 to obtain the angular velocity around the swing body 11 and a tilt sensor 28 to obtain the tilt angle in the front-rear and left-right directions of the swing body 11. The swing body 11 also includes a topography measuring device 30 that measures the topographical shape around the working machine 1 while swinging. The topographical shape is in the form of three-dimensional topographical data.

In one example, the topography measuring device 30 is a stereo camera having a pair of left and right cameras (cameras 30*a* and 30*b*), and is attached to face the rearward of the working machine 1. This topography measuring device 30 is electrically connected to a stereo camera controller 31, and sends the captured stereo image to the stereo camera controller 31. The direction that the topography measuring device 30 faces is not always rearward. The number of the topography measuring device 30 may be one or more. For the topography measuring device 30, a three-dimensional distance measuring sensor may be used instead of the stereo camera.

The stereo camera controller 31 sends a synchronization signal for synchronizing the imaging with the cameras 30*a* and 30*b* to the cameras 30*a* and 30*b*, performs a calculation of converting the two images from the cameras 30*a* and 30*b* into distance information, and transmits the calculated distance information to the controller 21.

The working front 12 includes a boom 13 that is rotatable relative to the swing body 11, an arm 14 at the distal end of the boom 13 to be rotatable, a bucket 15 at the distal end of the arm 14 to be rotatable, a boom cylinder 16 to drive the boom 13, an arm cylinder 17 to drive the arm 14, and a bucket cylinder 18 to drive the bucket 15. A boom angle sensor 23, an arm angle sensor 24, and a bucket angle sensor 25 are attached to the rotation shafts of the boom 13, the arm 14, and the bucket 15, respectively. These angle sensors obtain the rotation angles of the boom 13, the arm 14, and the bucket 15, and output the obtained results to the controller 21.

Figure 3:
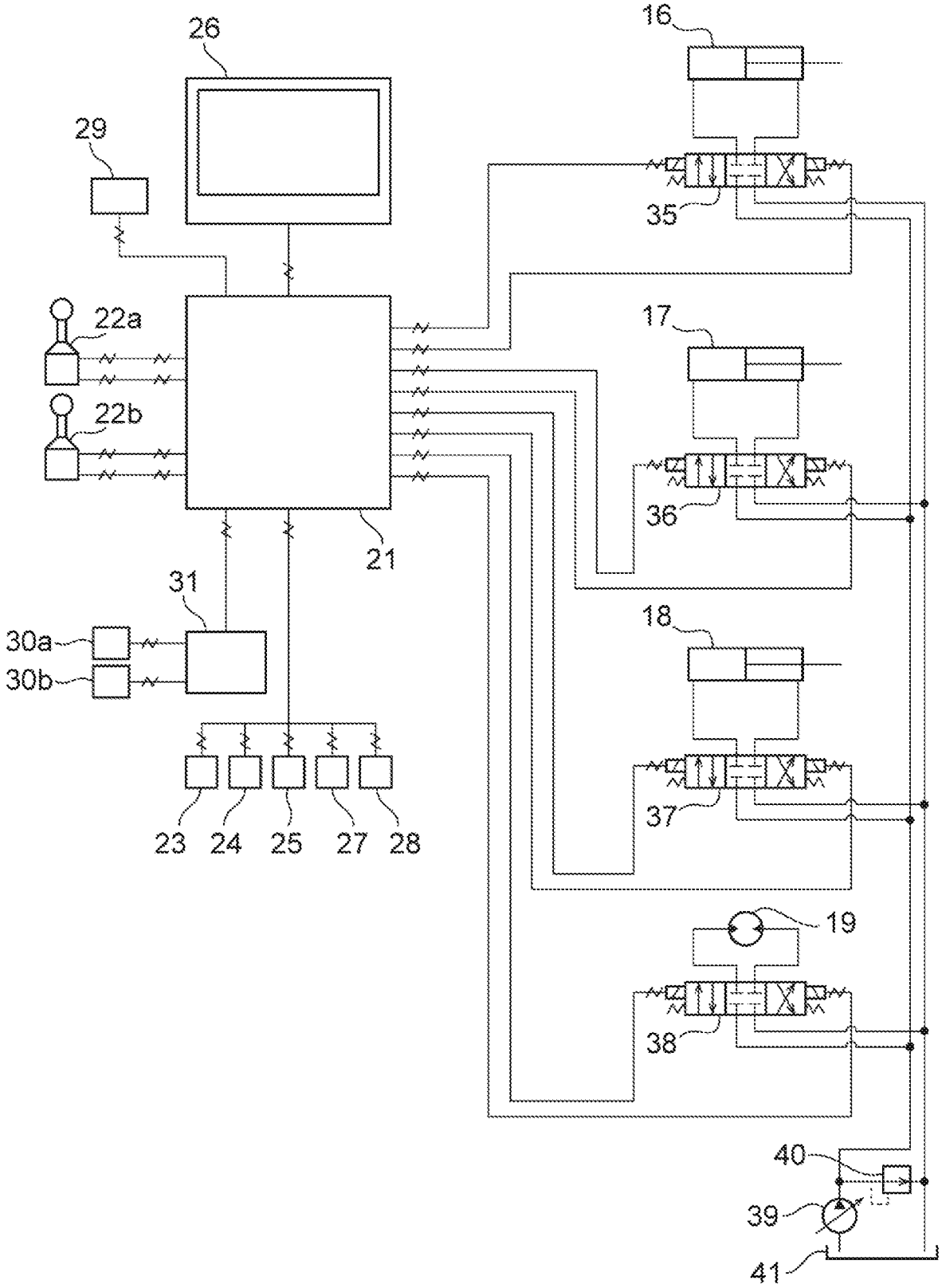
FIG. 3 shows a hydraulic circuit diagram showing the configuration of the working machine.

FIG. 3 shows a hydraulic circuit diagram showing the configuration of the working machine. As shown in FIG. 3, the pressure oil in a hydraulic oil tank 41 is discharged by a main pump 39, and is then supplied to the boom cylinder 16, the arm cylinder 17, the bucket cylinder 18, and the swing motor 19 through control valves 35 to 38, respectively. This drives the boom cylinder 16, the arm cylinder 17, the bucket cylinder 18 and the swing motor 19. In one example, the control valves 35 to 38 each includes a solenoid valve, and are controlled by the controller 21.

The pressure oil discharged by the main pump 39 is adjusted through a relief valve 40 so that the pressure does not become excessive. The pressure oil via the cylinders, the swing motor and the relief valve 40 returns to the hydraulic oil tank 41 again.

Receiving the electrical signals output from the operation levers 22*a* and 22*b*, the controller 21 converts the electrical signals into appropriate electrical signals to drive the control valves 35 to 38. The opening/closing amount of the control valves 35 to 38 changes with the displacement of the operation levers 22*a* and 22*b*. This adjusts the amount of pressure oil supplied to the boom cylinder 16, the arm cylinder 17, the bucket cylinder 18 and the swing motor 19.

In one example, the controller 21 receives signals from the boom angle sensor 23, the arm angle sensor 24, the bucket angle sensor 25, the swing gyroscope 27, the tilt sensor 28, the design data obtainment unit 29, and the stereo camera controller 31. Based on the received signals, the controller 21 calculates the position coordinates of the working machine 1, the posture of the working machine 1, and the surrounding topography of the working machine 1, and makes the display unit 26 display the calculated result.

Figure 4:
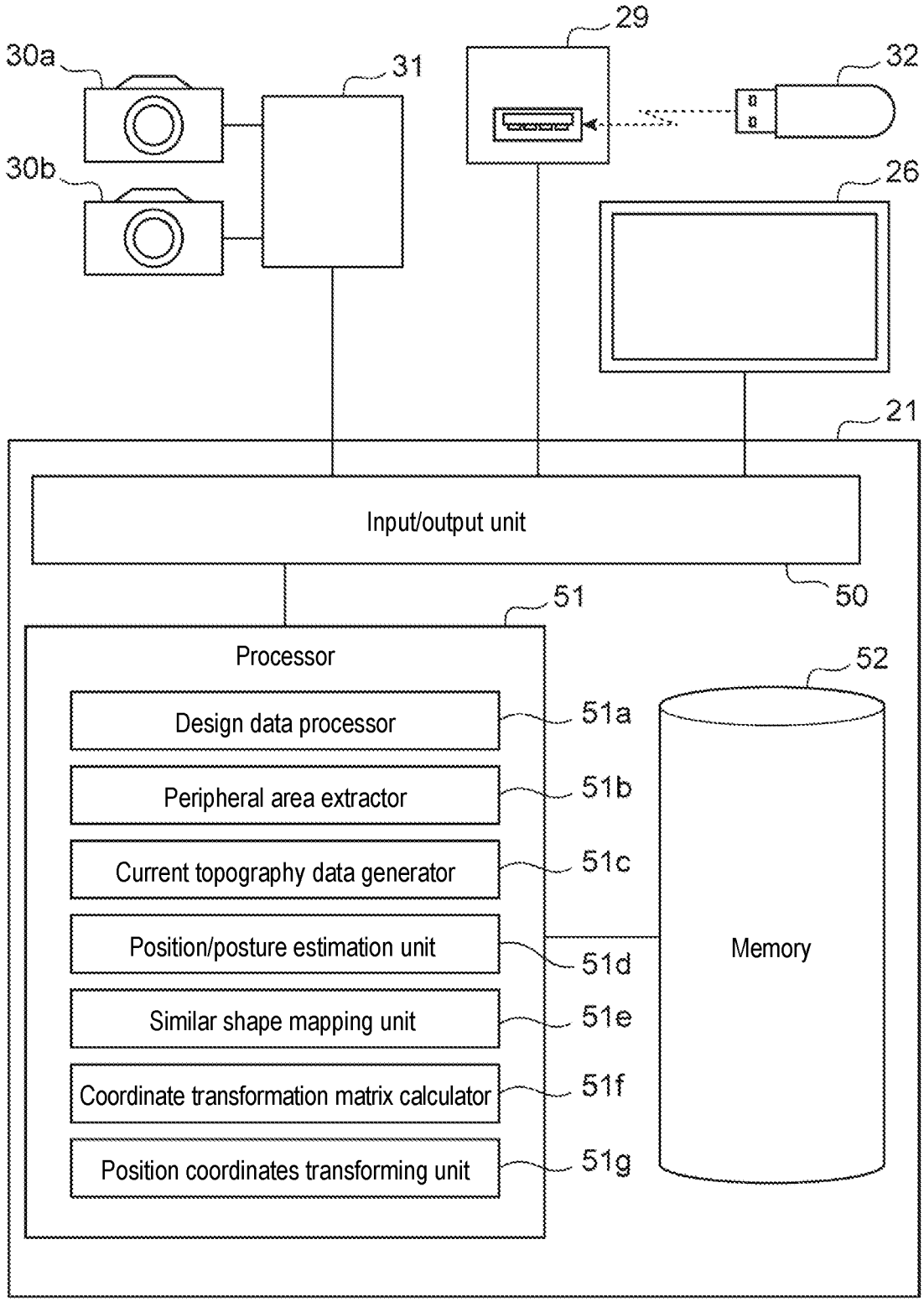
FIG. 4 is a schematic diagram of the configuration of a control system of the working machine.

FIG. 4 is a schematic diagram of the configuration of a control system of the working machine. As shown in FIG. 4, the control system of the working machine 1 includes the controller 21, and the stereo camera controller 31, the design data obtainment unit 29, and the display unit 26 that are electrically connected to the controller 21. In one example, the design data obtainment unit 29 is a universal serial bus (USB) port that is connectable to an external storage medium 32.

The controller 21 has an input/output unit 50, a processor 51, and a memory 52. The input/output unit 50 is an interface for connecting the controller 21 to devices such as the stereo camera controller 31, the design data obtainment unit 29, and the display unit 26. The processor 51 includes a microcomputer that is a combination of a central processing unit (CPU) and a graphics processing unit (GPU). The processor 51 further includes a design data processor 51*a*, a peripheral area extractor 51*b*, a current topography data generator 51*c*, a position/posture estimation unit 51*d*, a similar shape mapping unit 51*e*, a coordinate transformation matrix calculator 51*f*, and a position coordinates transforming unit 51*g*.

The design data processor 51*a* is configured to read design data, which is data in the design data coordinate system (first coordinate system), from the external storage medium 32 connected to the design data obtainment unit 29 via the input/output unit 50 and to write the read design data in the memory 52. The peripheral area extractor 51*b* is configured to read the design data stored in the memory 52, extract peripheral area shape data, which is shape data of a peripheral area in which construction is not performed, from the read design data, and write the extracted peripheral area shape data in the memory 52.

The current topography data generator 51*c* is configured to generate current topography data in the current topography coordinate system (second coordinate system) that is defined based on the installation position of the topography measuring device 30 (that is, the installation position of the working machine 1) based on the topography data measured by the topography measuring device 30 and input from the stereo camera controller 31, and write the generated current topography data in the memory 52. The current topography data relates to the topographical shape surrounding the working machine 1.

The position/posture estimation unit 51*d* is configured to estimate the self-position and posture of the working machine 1 in the current topography coordinate system based on the current topography data generated by the current topography data generator 51*c* (hereinafter, "the self-position and posture of the working machine" may be simply called "self-position and posture"), and write the coordinates of the estimated self-position and posture of the working machine 1 in the memory 52.

The similar shape mapping unit 51*e* is configured to search for similar shape portions between the peripheral area shape data extracted by the peripheral area extractor 51*b* and the current topography data generated by the current topography data generator 51*c*, and to map these searched similar shape portions. The coordinate transformation matrix calculator 51*f* is configured to calculate a coordinate transformation matrix that transforms from the current topography coordinate system to the design data coordinate system using the similar shape portions of the peripheral area shape data and the current topography data that are mapped by the similar shape mapping unit 51*e* so that the difference in coordinate values of the mapped similar shape portions is minimized, and to write the calculated coordinate transformation matrix in the memory 52.

The position coordinates transforming unit 51*g* is configured to transform the self-position and posture estimated by the position/posture estimation unit 51*d* and the current topography data from the coordinates of the current topography coordinate system to the coordinates of the design data coordinate system using the coordinate transformation matrix calculated by the coordinate transformation matrix calculator 51*f*.

The memory 52 includes a memory such as a random access memory (RAM) and a storage such as a hard disk drive or a solid state drive. This memory 52 is electrically connected to the processor 51 so that the processor 51 is able to write and read data there. In one example, the memory 52 stores the source codes of software to perform various process by the processor 51.

Next, referring to FIG. 5 to FIG. 22, the following describes the control process by the controller 21. The controller 21 executes the control process at a constant period, for example.

Figure 5:
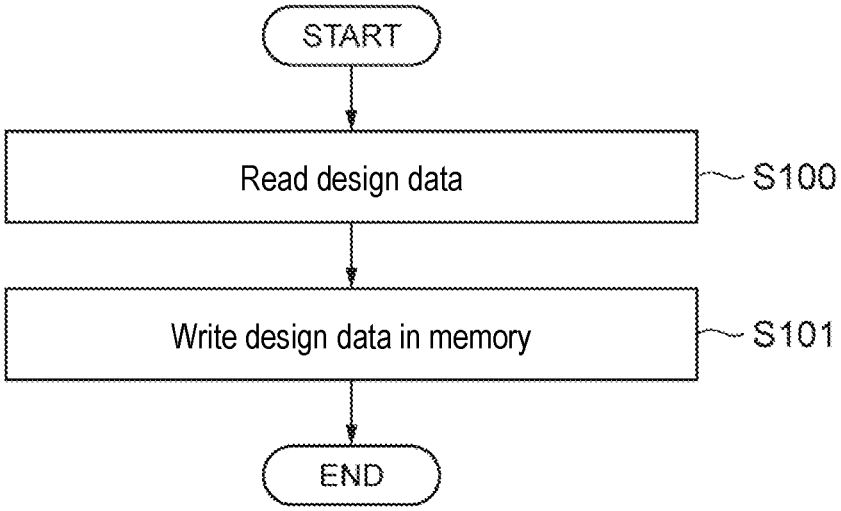
FIG. 5 is a flowchart showing the process by the controller.

FIG. 5 is a flowchart showing the process by the design data processor 51*a* of the processor 51. As shown in FIG. 5, in step S100, the design data processor 51*a* reads the design data from the external storage medium 32 connected to the design data obtainment unit 29 via the input/output unit 50.

Figure 6:
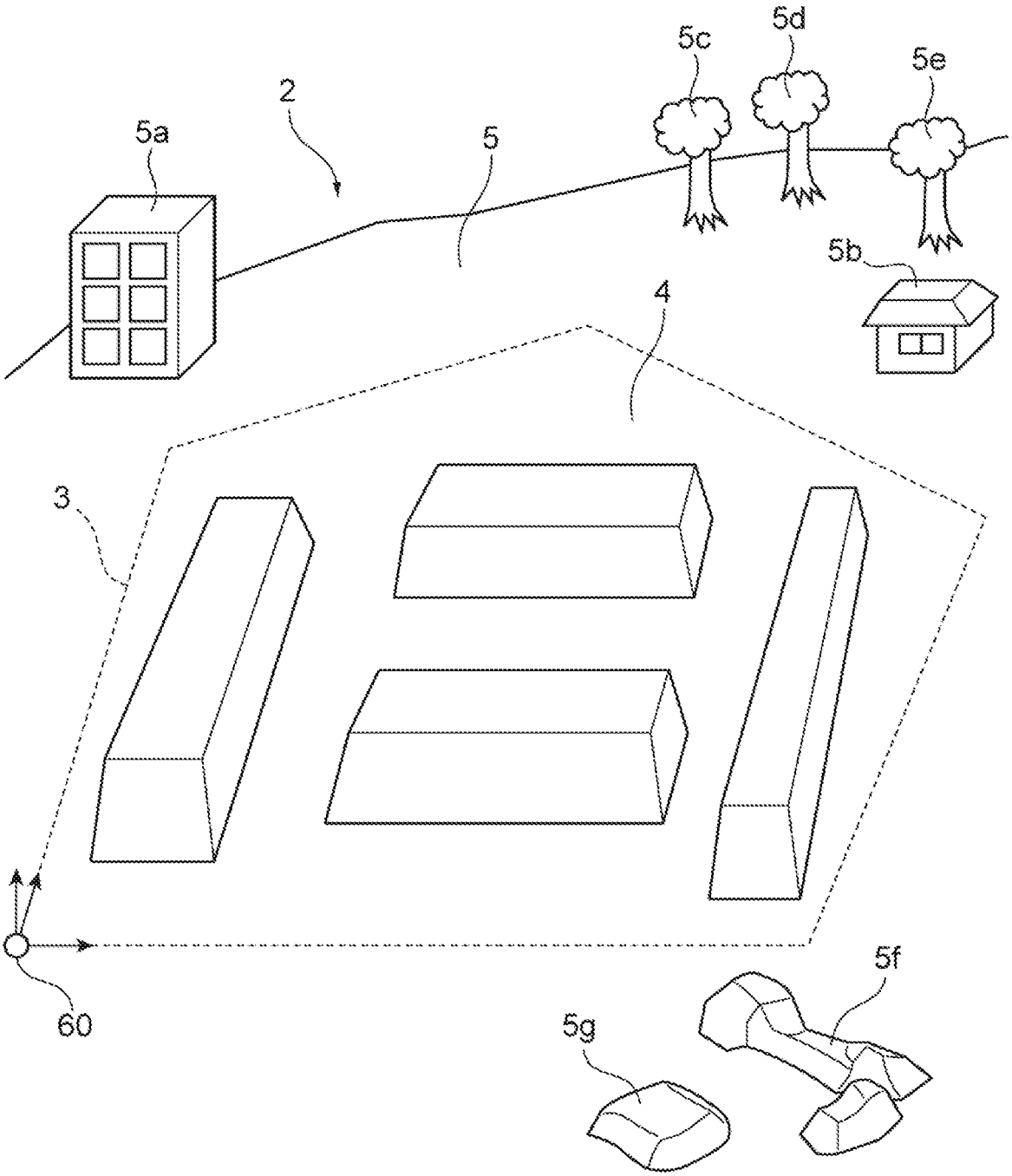
FIG. 6 schematically shows an example of the configuration of design data.
Figure 7:
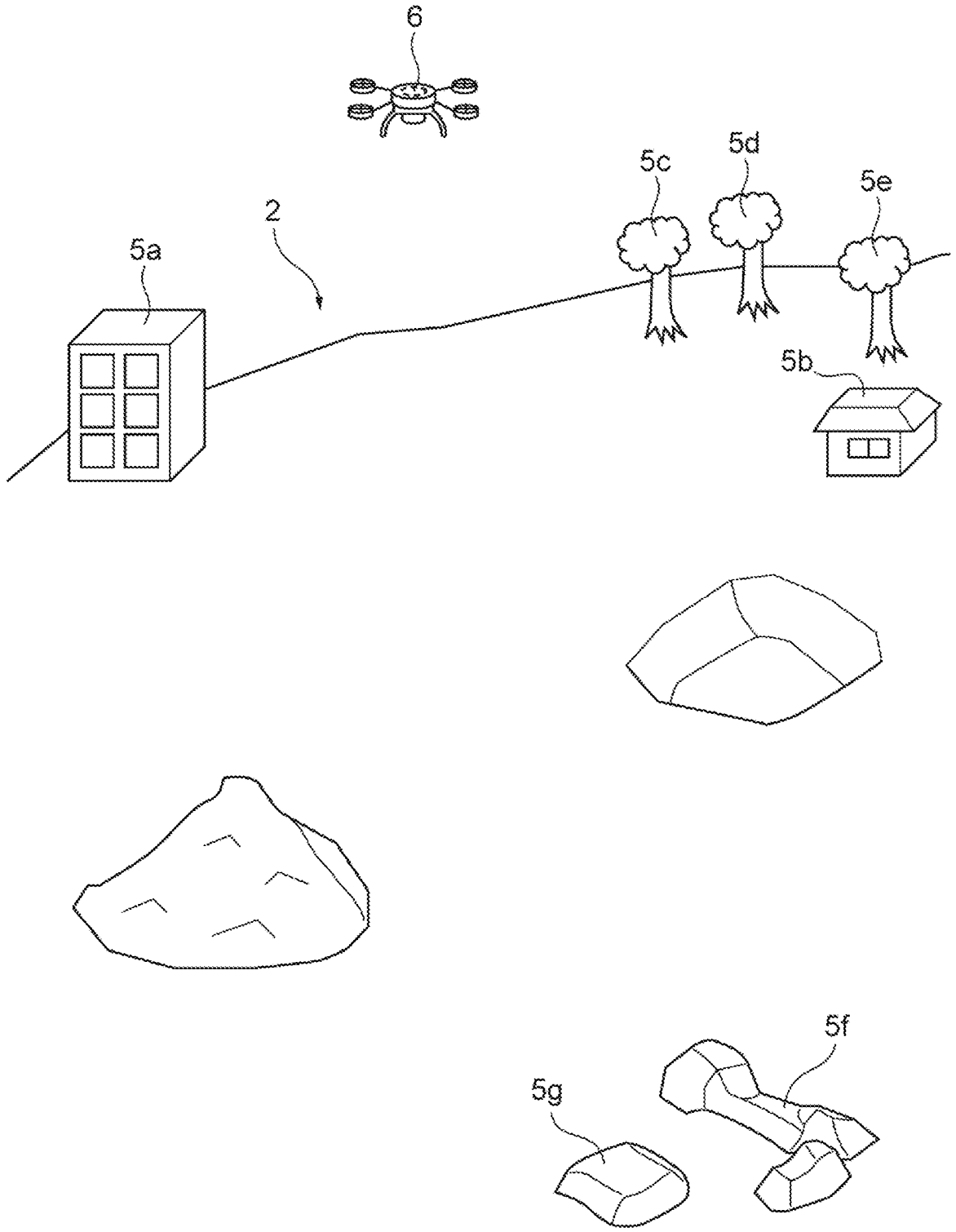
FIG. 7 schematically shows an example of the measurement at the start of the construction for survey.
Figure 8:
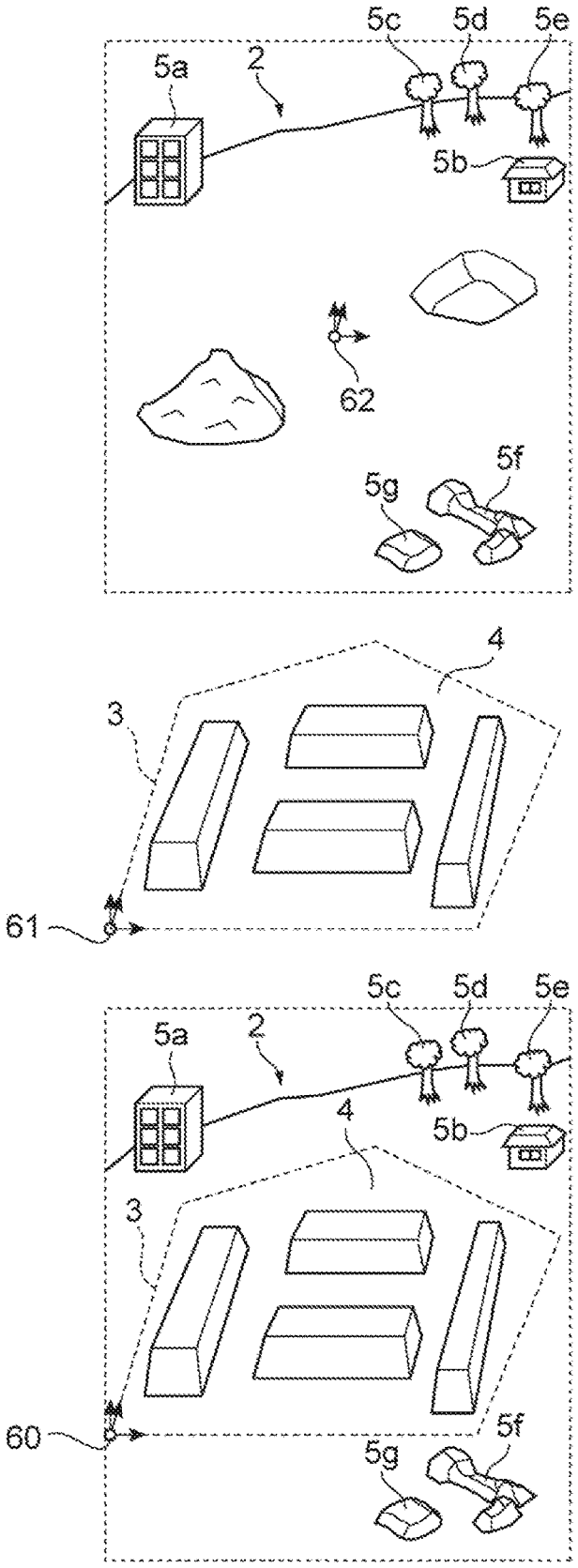
FIG. 8 schematically shows an example of creating design data.

Referring now to FIG. 6 to FIG. 8, an example of the design data is described. The design data is the data on the construction target 2 after the completion of the construction. The design data includes information on the topography data, a reference point 60 of the construction-site coordinate system, and the construction boundary 3, and also includes information on whether the shape of the design data corresponds to the construction area 4 or the peripheral area 5. In this example, the construction is performed in the design data coordinate system. The construction-site coordinate system is therefore the same as the design data coordinate system, meaning that the design data is in the construction-site coordinate system. In the following description, the design data coordinate system may be referred to as the construction-site coordinate system.

The design data is created using the pre-construction topographical data measured at the start of the construction for survey and the drawing data for the construction. FIG. 7 schematically shows an example of the measurement at the start of construction for survey. During the measurement at the start of construction for survey, the topographical shape of the construction target 2 before construction is measured using the UAV 6. The UAV 6 is equipped with measurement instruments such as a laser scanner and a camera facing downward so that, looking down from the UAV 6, the UAV 6 can measure the topographical shape of the construction target 2.

FIG. 8 schematically shows an example of creating design data, and the upper part of FIG. 8 shows the topographical data of the construction target 2 before construction. This pre-construction topographical data includes a reference point 62 in the pre-construction topography data coordinate system. The middle part of FIG. 8 shows the drawing data of construction created by CAD or the like. This construction drawing contains information on a reference point 61 and the construction boundary 3. The lower part of FIG. 8 shows the design data. The design data is about the shape of the construction target 2 after the completion of the construction, which is created by overlapping the drawing data on the pre-construction topography data. For the reference point 60 of the created design data coordinate system, the reference point 61 in the coordinate system of the construction drawing is used. The design data created by the designer, the construction manager, or the like is stored in the external storage medium 32, and is loaded into the controller 21 via the design data obtainment unit 29.

In step S101 following step S100, the design data processor 51*a* writes the read design data in the memory 52.

Figure 9:
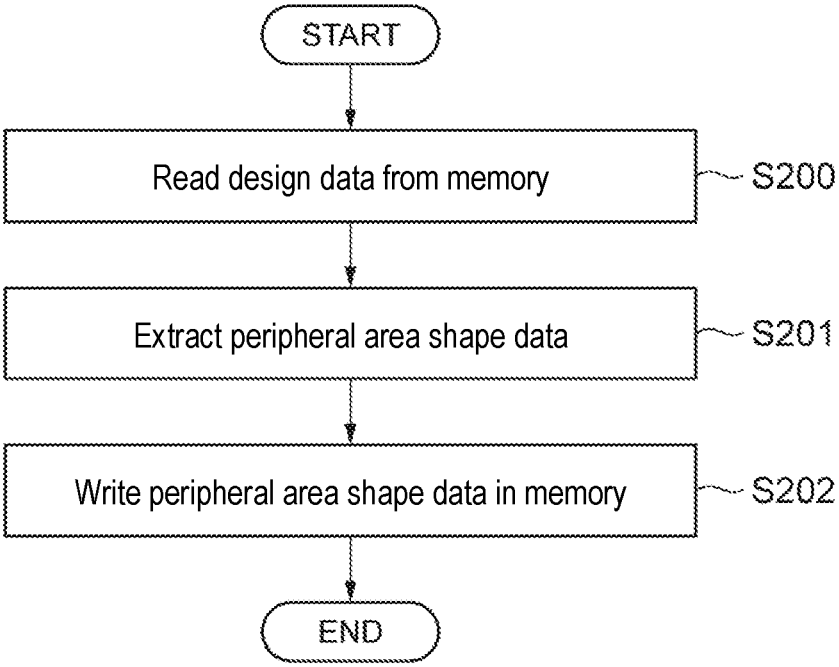
FIG. 9 is a flowchart showing the process by the controller.
Figure 10:
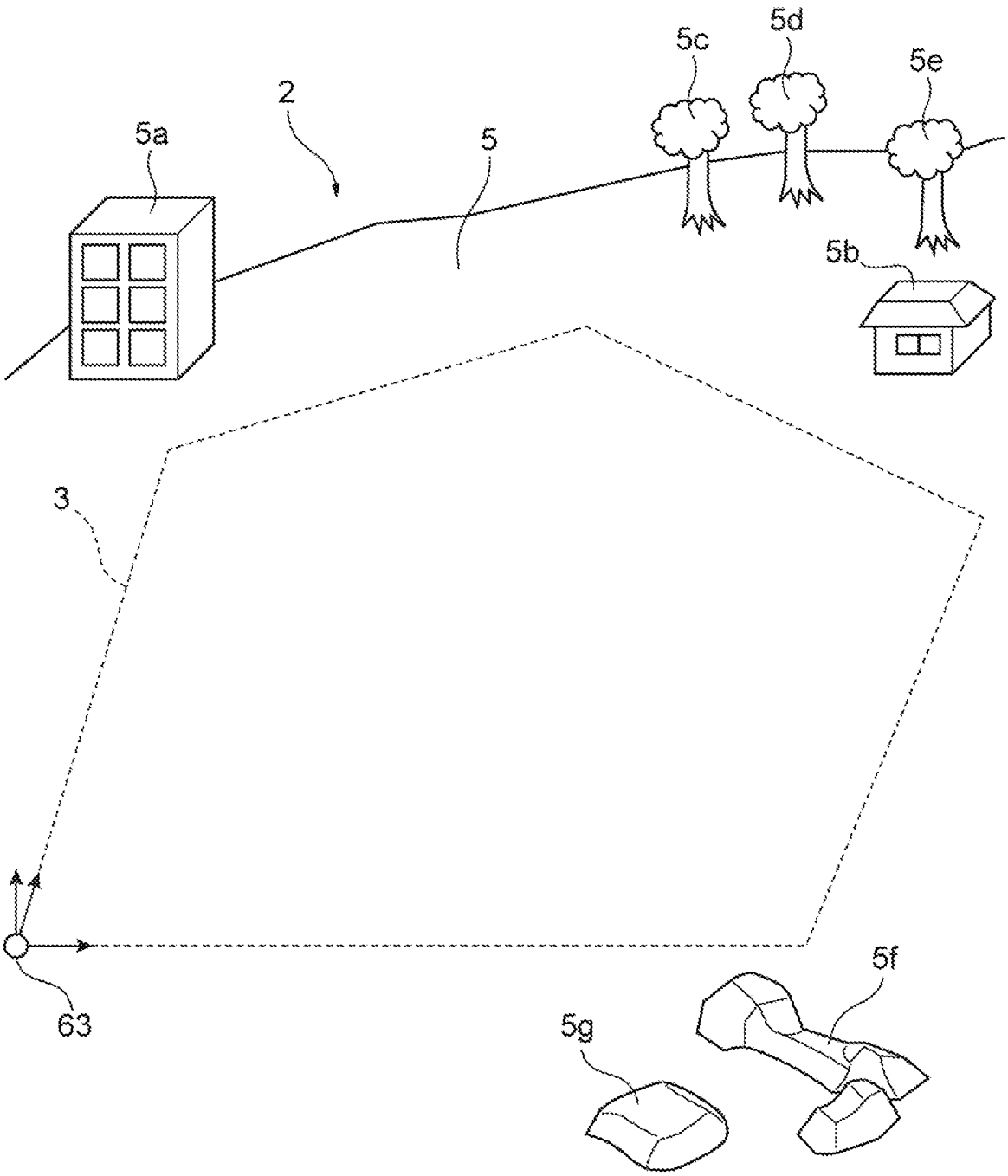
FIG. 10 schematically shows an example of extracting a peripheral area.

FIG. 9 is a flowchart showing the process by the peripheral area extractor 51*b*. As shown in FIG. 9, in step S200, the peripheral area extractor 51*b* reads the design data from the memory 52. In step S201 following step S200, the peripheral area extractor 51*b* extracts peripheral area shape data from the read design data. The peripheral area shape data is about the peripheral area 5 excluding the construction area 4, and can be easily extracted using the information on the construction boundary 3, the construction area 4, and the peripheral area 5 included in the design data. FIG. 10 shows an example of the peripheral area shape data extracted from the design data. The reference point 63 of the coordinate system of the peripheral area shape data is the same as the reference point 60 in the design data coordinate system (see FIG. 6).

In step S202 following step S201, the peripheral area extractor 51*b* writes the extracted peripheral area shape data in the memory 52.

Figure 11:
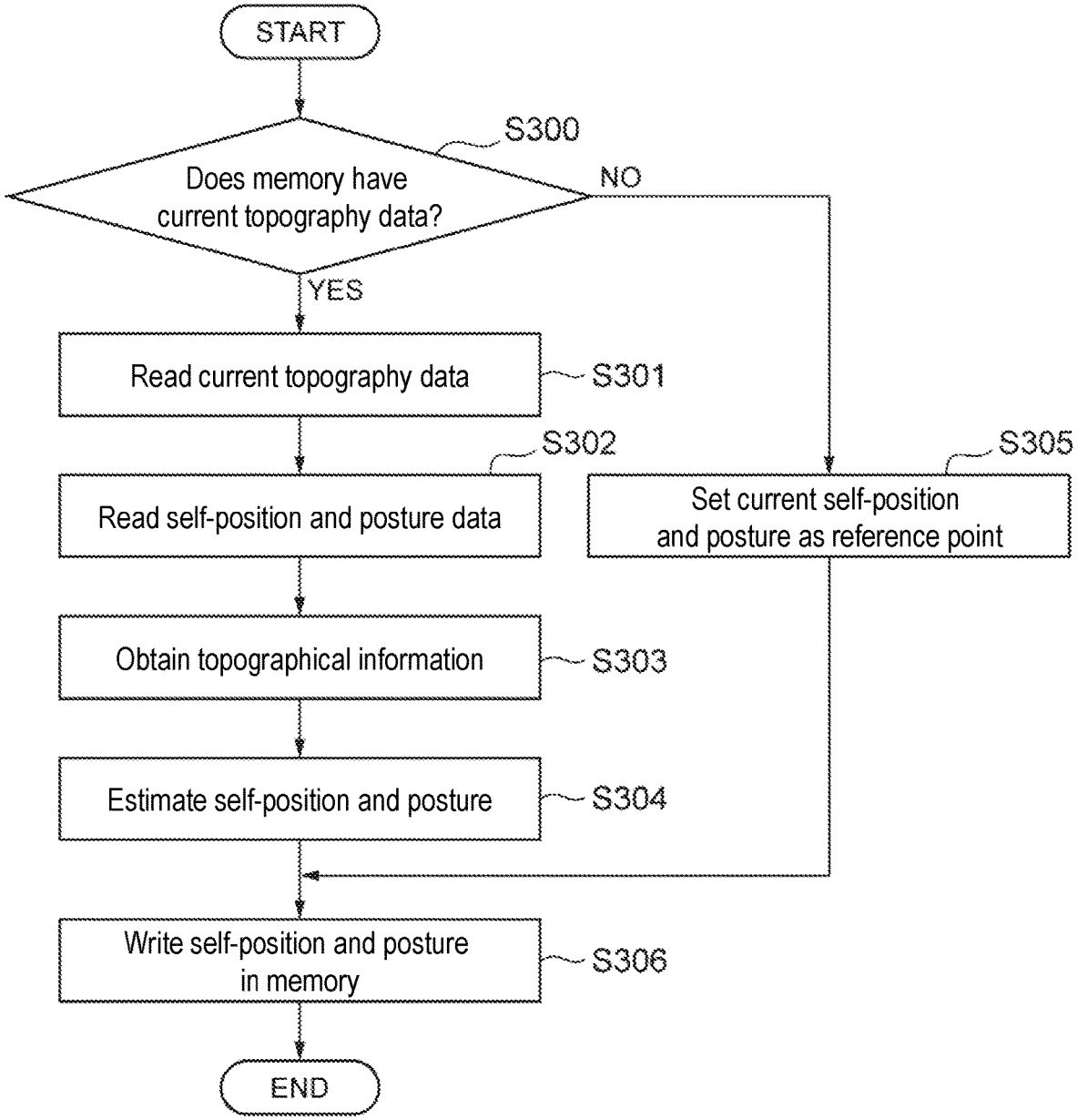
FIG. 11 is a flowchart showing the process by the controller.
Figure 12:
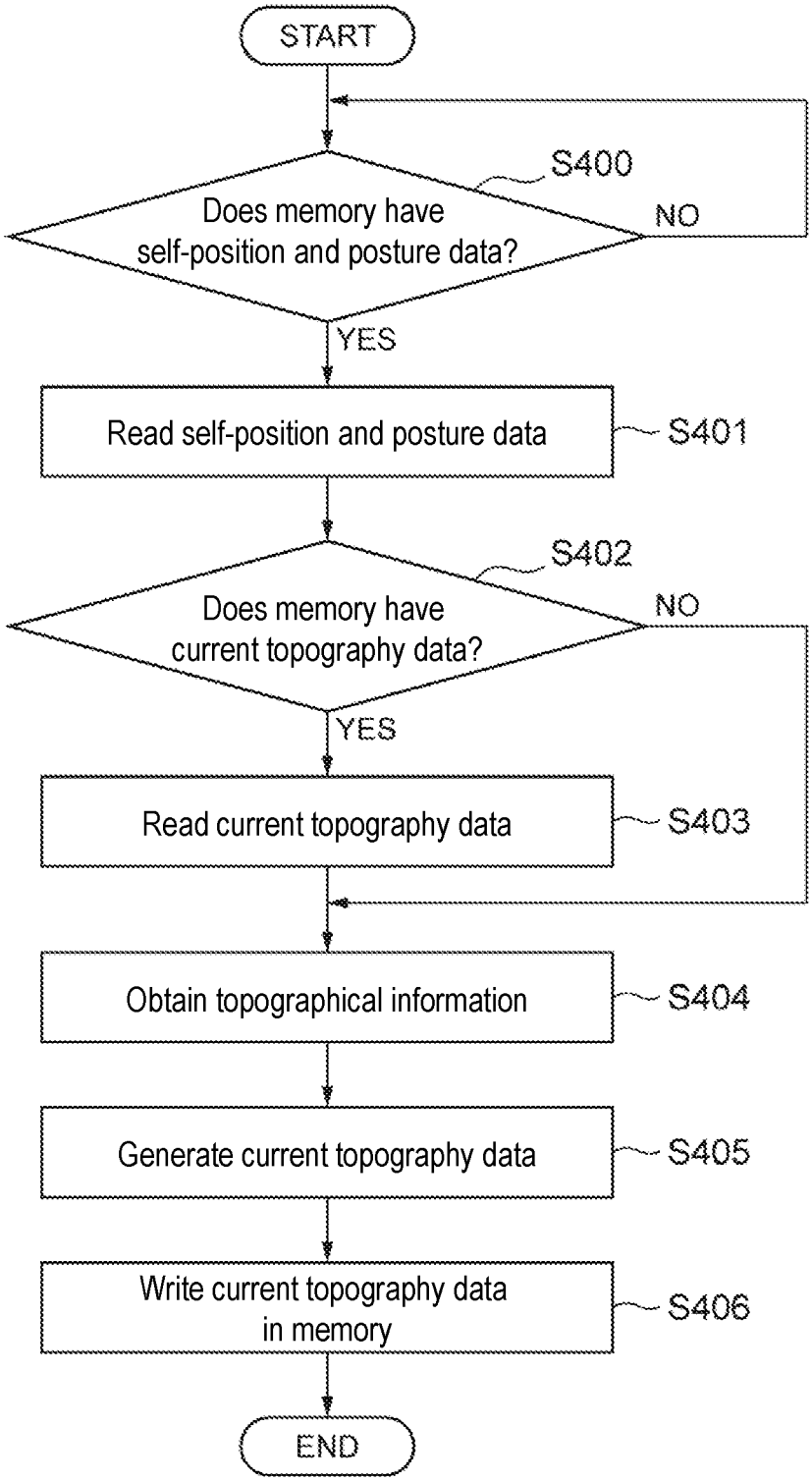
FIG. 12 is a flowchart showing the process by the controller.
Figure 13:
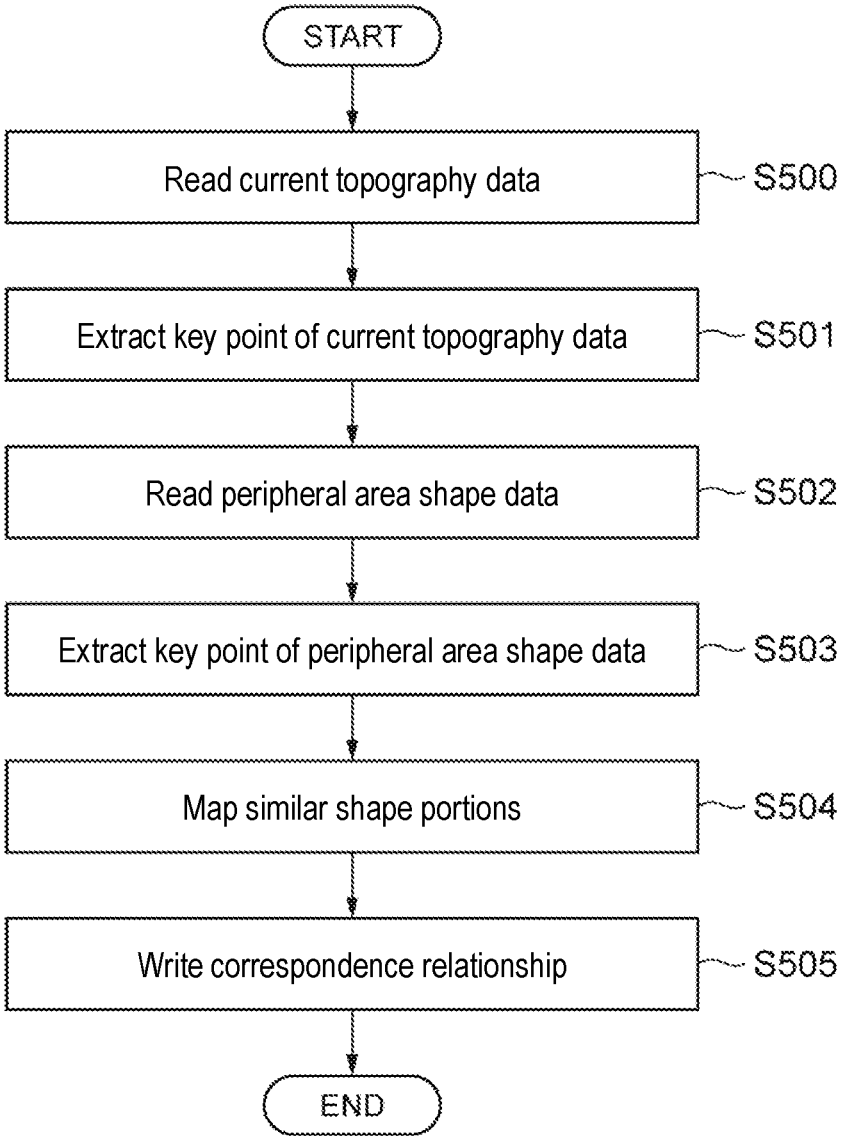
FIG. 13 is a flowchart showing the process by the controller.

Referring next to FIG. 11 to FIG. 13, the following describes generation of the current topography data by the current topography data generator 51*c* and estimation of the self-position and posture of the working machine 1 by the position/posture estimation unit 51*d* using simultaneous localization and mapping (SLAM) technology, which is often used in the field of mobile robots. The position/posture estimation unit 51*d* estimates the self-position and posture of the working machine 1 using the same coordinate system as in the current topography data generated by the current topography data generator 51*c* (i.e., the current topography coordinate system).

FIG. 11 is a flowchart by the position/posture estimation unit 51*d* to estimate the self-position and posture. As shown in FIG. 11, in step S300, the position/posture estimation unit 51*d* determines whether or not the current topography data written by the current topography data generator 51*c* exists in the memory 52. If it is determined that the current topography data exists in the memory 52, the control process proceeds to step S301. If it is determined that the data does not exist, the control process proceeds to step S305.

In step S301, the position/posture estimation unit 51*d* reads the current topography data from the memory 52. In step S302 following step S301, the position/posture estimation unit 51*d* reads the self-position and posture data one cycle before the process by the position/posture estimation unit 51*d* from the memory 52.

In step S303 following step S302, the position/posture estimation unit 51*d* obtains topographical information from the stereo camera controller 31. For example, the position/posture estimation unit 51*d* obtains topographical information (i.e., topography data) in the measurement range of the topography measuring device 30 from the stereo camera controller 31.

In step S304 following step S303, the position/posture estimation unit 51*d* estimates the self-position and posture of the working machine 1 in the current topography data coordinate system based on the current topography data read in step S301. For example, the position/posture estimation unit 51*d* uses the current topography data read in step S301 and the self-position and posture data one cycle before read in step S302, and estimates the self-position and posture from the topographical information obtained in step S303 in the vicinity of the position one cycle before using the shape matching technique so that the topographical information obtained in step S303 can be obtained. The position/posture estimation unit 51*d* may calculate the optical flow using the images obtained from the topography measuring device 30 to estimate the self-position and posture.

In step S306 following step S304, the position/posture estimation unit 51*d* writes the self-position and posture in the current topography coordinate system estimated in step S304 in the memory 52.

In step S305, the position/posture estimation unit 51*d* sets the self-position and posture at the timing of performing the control process (that is, the current self-position and posture) as the reference point of the current topography coordinate system. Then, the set reference point serves as the reference point of the current topography data generated by the current topography data generator 51*c*. In step S306 following step S305, the position/posture estimation unit 51*d* writes the self-position and posture in the current topography coordinate system set in step S305 in the memory 52.

FIG. 12 is a flowchart by the current topography data generator 51*c* to generate current topography data. As shown in FIG. 12, in step S400, the current topography data generator 51*c* determines whether the self-position and posture data exists in the memory 52. If it is determined that the self-position and posture data exists in the memory 52, the control process proceeds to step S401. If it is determined that the data does not exist, step S400 is repeated.

In step S401 following step S400, the current topography data generator 51*c* reads the self-position and posture data from the memory 52. In step S402 following step S401, the current topography data generator 51*c* determines whether or not the current topography data exists in the memory 52. If it is determined that the current topography data exists in the memory 52, the control process proceeds to step S403. If it is determined that the data does not exist, the control process proceeds to step S404.

In step S403 following step S402, the current topography data generator 51*c* reads the current topography data from the memory 52. In step S404 following step S403, the current topography data generator 51*c* obtains topographical information (i.e., topography data) in the measurement range of the topography measuring device 30 from the stereo camera controller 31.

In step S405 following step S404, the current topography data generator 51*c* generates the current topography data surrounding the working machine 1. Specifically, the current topography data generator 51*c* uses the current topography data read in step S403, the self-position and posture data read in step S401, and the positional relationship between the self-position and posture and the topography measuring device 30 to calculate the position and posture of the topography measuring device 30 in the working machine 1 in the current topography coordinate system. The current topography data generator 51*c* then transforms the topography data obtained in step S404 into the topography data in the current topography coordinate system to generate and update the current topography data. The current topography data is updated when the topography data measured by the topography measuring device 30 overlaps with the previous current topography data.

In step S406 following step S405, the current topography data generator 51*c* writes the current topography data generated in step S405 in the memory 52.

The process by the position/posture estimation unit shown in FIG. 11 and the process by the current topography data generator shown in FIG. 12 have a parallel relationship. That is, the process by the position/posture estimation unit 51*d* uses the result generated by the current topography data generator 51*c*, and the process by the current topography data generator 51*c* uses the result estimated by the position/posture estimation unit 51*d*.

Figure 14:
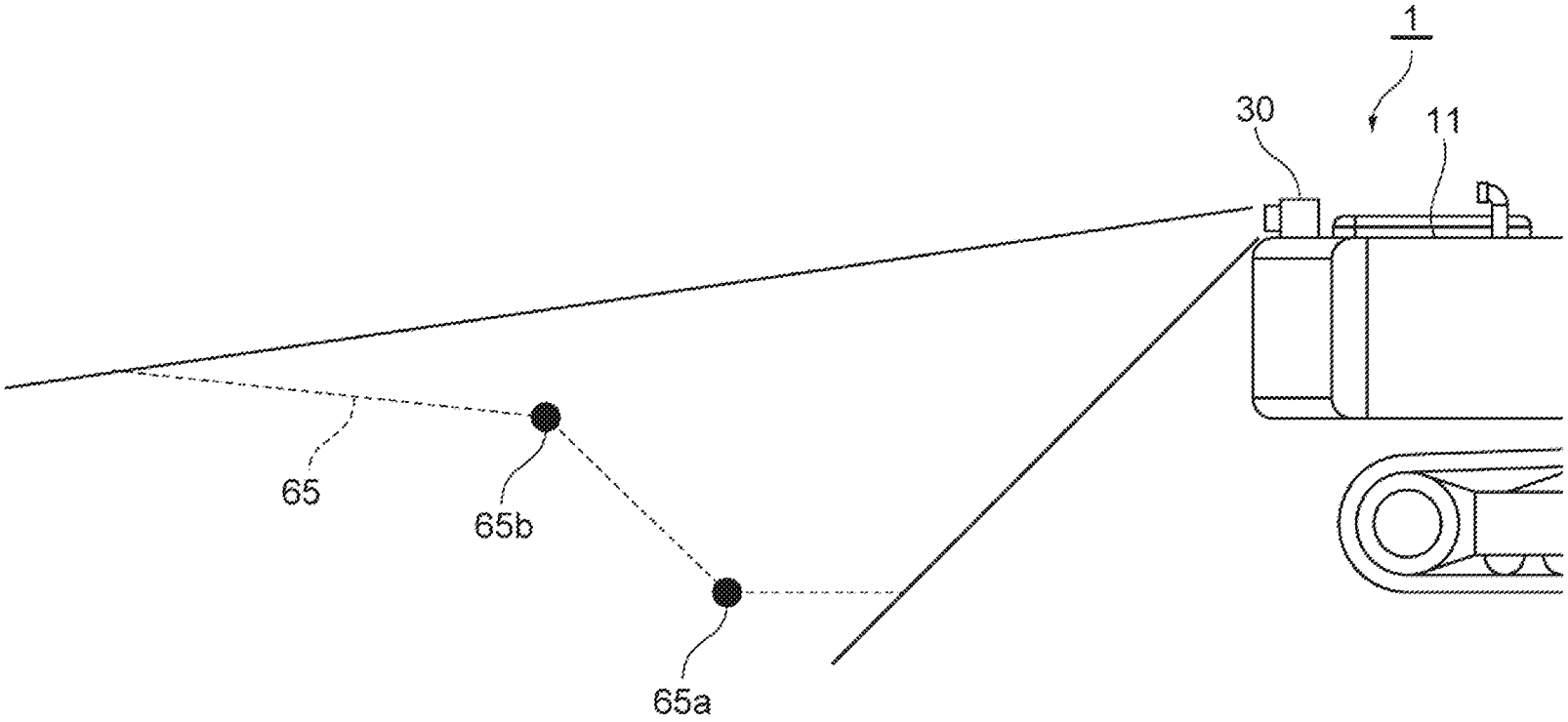
FIG. 14 is a side view showing an example of extracting key points.
Figure 15:
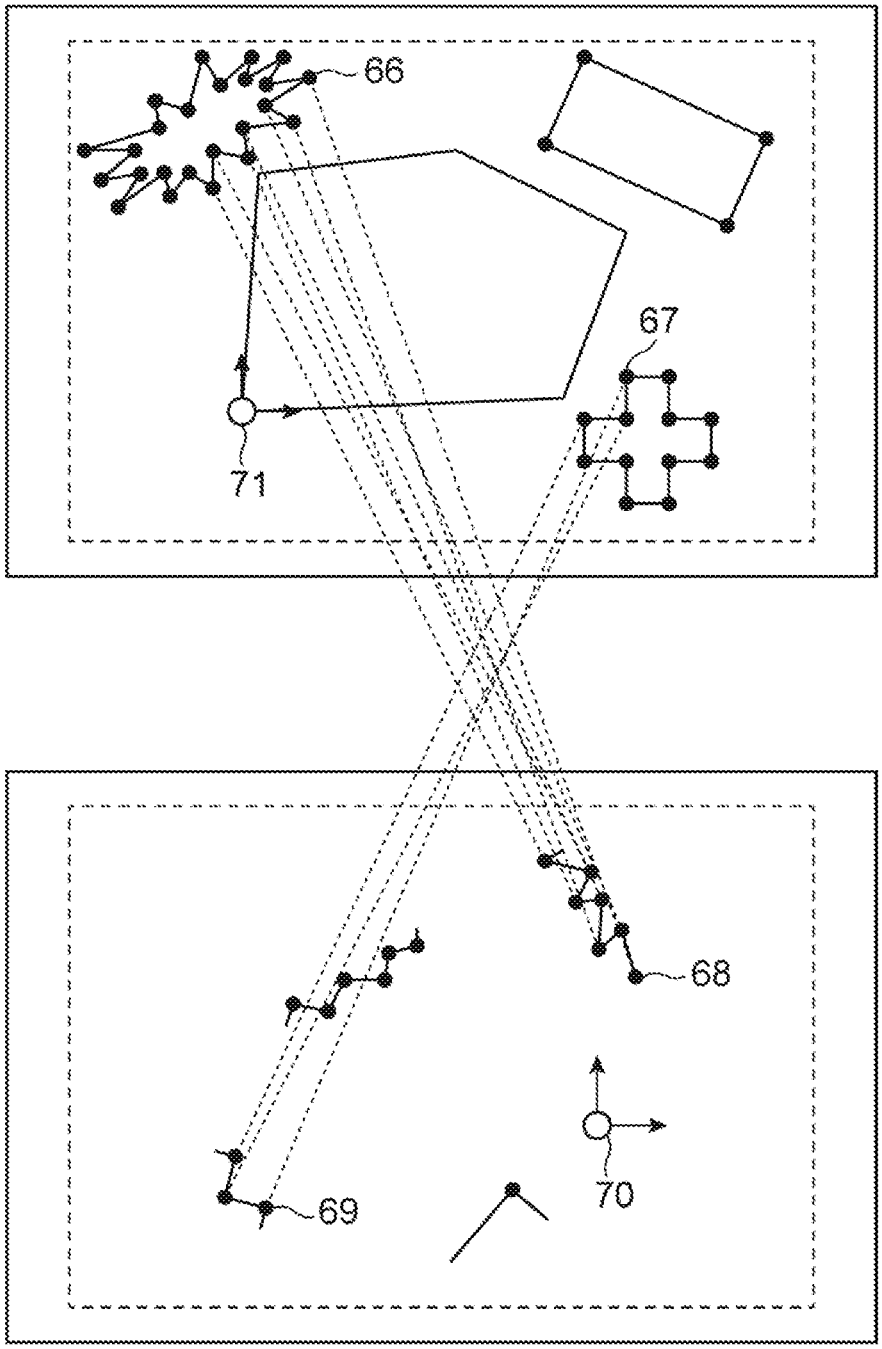
FIG. 15 schematically shows an example of mapping similar shape portions.

Referring now to FIG. 13 to FIG. 15, the following describes the process by the similar shape mapping unit 51*e* of searching for a similar shape portion between the peripheral area shape data extracted by the peripheral area extractor 51*b* and the current topography data generated by the current topography data generator 51*c*, and mapping these similar shape portions.

FIG. 13 is a flowchart showing the process by the similar shape mapping unit 51*e*. As shown in FIG. 13, in step S500, the similar shape mapping unit 51*e* reads the current topography data generated by the current topography data generator 51*c* from the memory 52. In step S501 following step S500, the similar shape mapping unit 51*e* extracts a key point of the current topography data from the current topography data read in step S500. The key point is a characteristic point, e.g., a point in the topography where the inclination changes abruptly, or an apex. For example, as shown in FIG. 14, the topography data 65 measured by the topography measuring device 30 installed in the swing body 11 includes points 65*a* and 65*b* at which the inclination of the topography changes, and these points are the key points. Key points can also be extracted using algorithms such as Uniform Sampling if the topography is point cloud information.

In step S502 following step S501, the similar shape mapping unit 51*e* reads the peripheral area shape data extracted by the peripheral area extractor 51*b* from the memory 52. In step S503 following step S502, the similar shape mapping unit 51*e* extracts key points of the peripheral area shape data read in step S502.

In step S504 following step S503, the similar shape mapping unit 51*e* maps similar shape portions between the peripheral area shape data and the current topography data. Specifically, the similar shape mapping unit 51*e* compares the key points of the current topography data extracted in step S501 with the key points of the peripheral area shape data extracted in step S503, and searches for a portion having similar shapes (i.e., similar shape portions) by matching sequentially, and maps these similar shape portions.

FIG. 15 shows an example of the process of mapping similar shape portions. The upper part of FIG. 15 shows shape data of the surrounding topography and its key points, and the lower part of FIG. 15 shows the current topography data and its key points. Using the positional relationship between the key points in the upper and lower parts of FIG. 15 enables mapping of the similar shape portions. For example, the key point 66 in the upper part of FIG. 15 and the key point 68 in the lower part of FIG. 15 have a correspondence relationship, and the key point 67 in the upper part of FIG. 15 and the key point 69 in the lower part of FIG. 15 have a correspondence relationship. Reference numerals 70 and 71 in FIG. 15 denote reference points of the coordinate system.

In step S505 following step S504, the similar shape mapping unit 51*e* writes the correspondence relationship between the peripheral area shape data and the current topography data (in other words, the mapped similar shape portions) obtained in step S504 in the memory 52.

Figure 16:
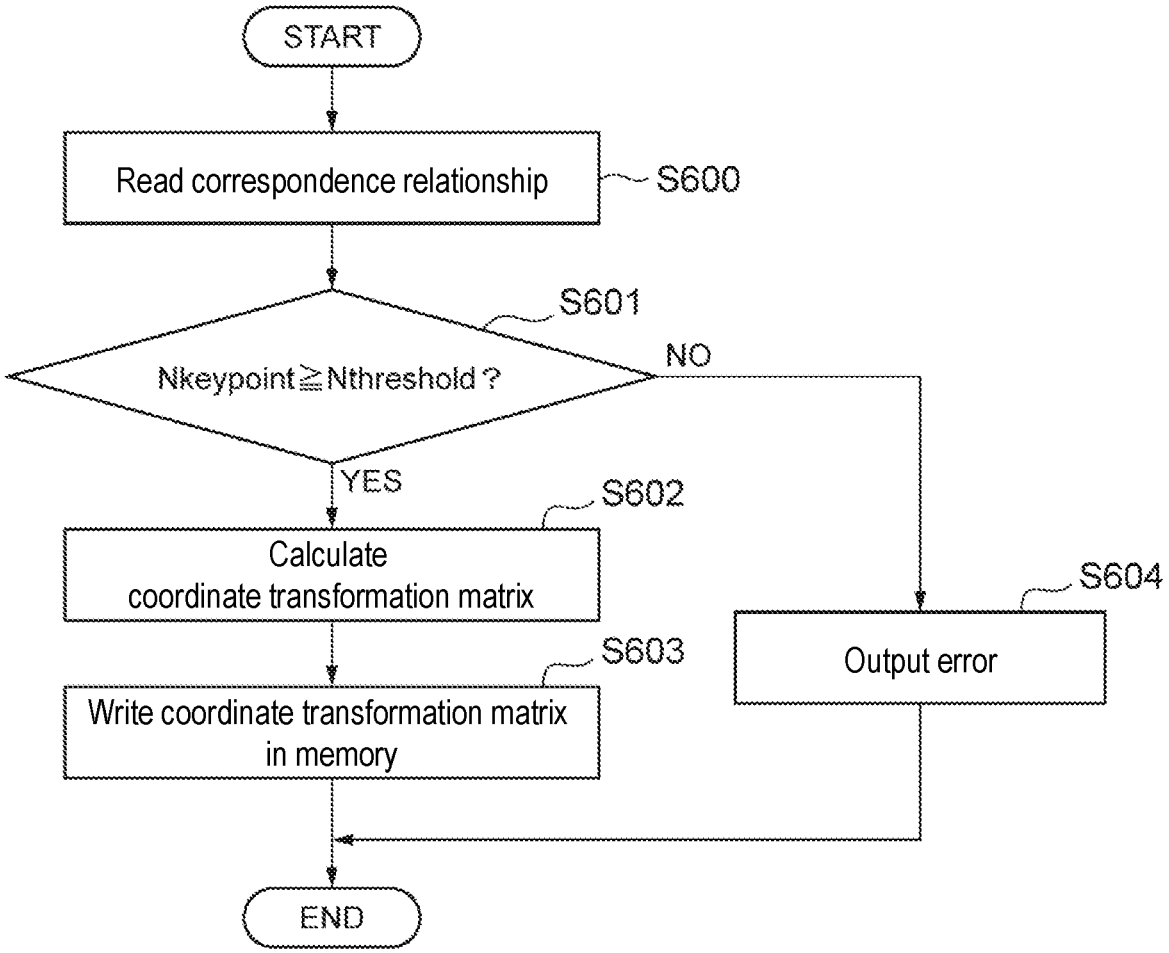
FIG. 16 is a flowchart showing the process by the controller.
Figure 17:
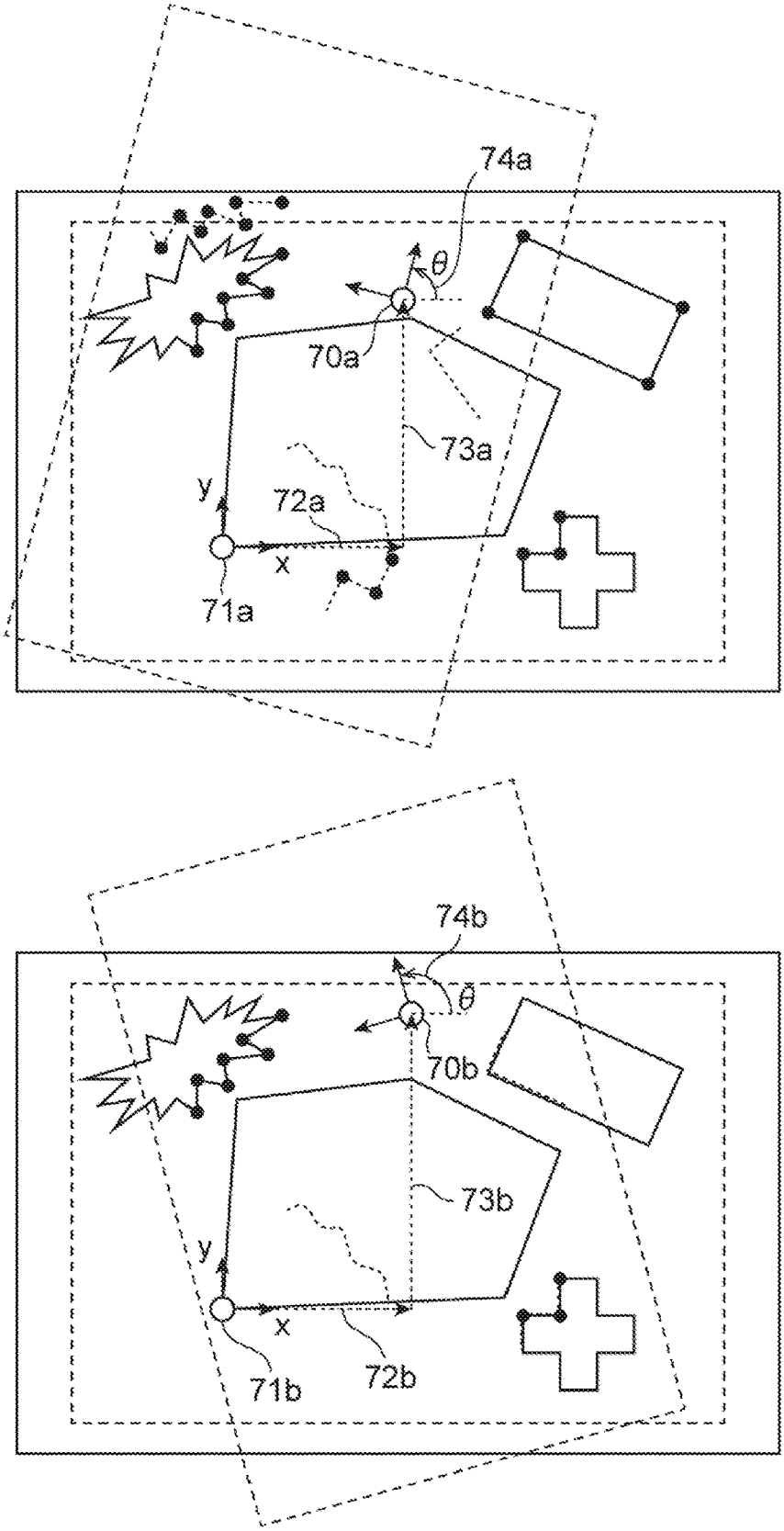
FIG. 17 is a schematic diagram showing an example of obtaining a coordinate transformation matrix.

Referring next to FIG. 16 and FIG. 17, the following describes the process of calculating a coordinate transformation matrix to transform from the current topography coordinate system to the construction-site coordinate system, which is the coordinate system of the peripheral area shape data, using the above-mentioned correspondence relationship between the peripheral area shape data and the current topography data.

FIG. 16 is a flowchart showing the process by the coordinate transformation matrix calculator 51*f*. As shown in FIG. 16, in step S600, the coordinate transformation matrix calculator 51*f* reads the correspondence relationship between the peripheral area shape data and the current topography data from the memory 52. In step S601 following step S600, the coordinate transformation matrix calculator 51*f* compares the number of mapped key points (Nkeypoint) with a predetermined threshold (Nthreshold).

There may be no key points mapped between the generated current topography data and the peripheral area shape data, or the number of mapped key points may be too small to uniquely determine the positioning between the peripheral area shape data and the generated current topography data. The threshold (Nthreshold) is set to prevent the failure of positioning of the key points between the peripheral area shape data and the current topography in these cases. For example, for a two-dimensional shape, Nthreshold=3 because three pairs of key points are required to be mapped for positioning, and for a three-dimensional shape, Nthreshold=4 because four pairs of key points are required. The threshold (Nthreshold) may be larger than 3 or 4.

If the number of mapped key points (Nkeypoint) is equal to or greater than the threshold (Nthreshold), the control process proceeds to step S602. If the number of the mapped key points (Nkeypoint) is less than the threshold (Nthreshold), the control process proceeds to step S604.

In step S602, the coordinate transformation matrix calculator 51*f* performs positioning of the peripheral area shape data with the current topography data generated by the current topography data generator 51*c*, and calculates a coordinate transformation matrix. For example, in the case of two-dimensional shape data, the coordinate transformation matrix calculator 51*f* obtains a coordinate transformation matrix H that represents the positional relationship between the reference point of the peripheral area shape data and the reference point of the current topography data. The coordinate transformation matrix H is obtained by the following equation (1) using the translation matrix T, rotation matrix R and scaling matrix S.

$$H = T \times R \times S \qquad \text{Equation (1)}$$

Using the values of translation x in the x direction, translation y in the y direction, rotation angle θ, and scaling factor s for the translation matrix T, rotation matrix R, and scaling matrix S in equation (1), the following equations (2) to (4) will be obtained:

$$T = \begin{pmatrix} 1 & 0 & x; \\ 0 & 1 & y; \\ 0 & 0 & 1 \end{pmatrix} \qquad \text{Equation (2)}$$

$$R = \begin{pmatrix} \cos(\theta) & -\sin(\theta) & 0; \\ \sin(\theta) & \cos(\theta) & 0; \\ 0 & 0 & 1 \end{pmatrix} \qquad \text{Equation (3)}$$

$$S = \begin{pmatrix} s & 0 & 0; \\ 0 & s & 0; \\ 0 & 0 & 1 \end{pmatrix} \qquad \text{Equation (4)}$$

In these equations, x and y of the translation matrix T, θ of the rotation matrix R, and s of the scaling matrix S can be calculated using algorithms such as iterative closest point (ICP), Softassign, and EM-ICP. For example, the key points of the current topography data are converted into coordinate values in the construction-site coordinate system, using the mapped key points. Then, x, y, θ, and s that minimize the distance between the key points of the current topography data in the construction-site coordinate system and the corresponding key points of the peripheral area shape data are calculated by iterative operation. Thus, the coordinate transformation matrix H is obtained using the translation matrix T, rotation matrix R and scaling matrix S.

When transforming the coordinate values (X1, Y1) in the current topography coordinate system to the coordinate values (X2, Y2) in the construction-site coordinate system, the calculation can be made using the following equation (5).

$$tr(X2 \quad Y2 \quad 1) = H \times tr(X1 \quad Y1 \quad 1) \qquad \text{Equation (5)}$$

FIG. 17 shows an example of the peripheral area shape data and the current topography data after mapping. In this example, the translation 72*a*, 72*b* in the x direction, the translation 73*a*, 73*b* in the y direction, the rotation angle 74*a*, 74*b*, and the scaling factor s are obtained so that the distance between the mapped key points after coordinate transformation is minimized, in other words, the difference in the coordinate values of the mapped similar shape portions is minimized. The scaling factor s is the reciprocal of the enlarged magnification. For example, when the current topography coordinate system is enlarged double, s becomes 0.5. FIG. 17 shows an example of the scaling factor s=1. In this example, the distance between the mapped key points is smaller in the lower part than in the upper part of FIG. 17. This means that 72*b*, 73*b*, and 74*b* in the lower part of FIG. 17 are appropriate for x, y, θ, and s for obtaining the coordinate transformation matrix H. In FIG. 17, reference numerals 70*a*, 70*b*, 71*a*, and 71*b* denote reference points of the coordinate system.

In step S603 following step S602, the coordinate transformation matrix calculator 51*f* writes the coordinate transformation matrix H calculated in step S602 in the memory 52. In step S604, the coordinate transformation matrix calculator 51*f* performs error processing. For example, the coordinate transformation matrix calculator 51*f* displays a message such as "Insufficient measurement points; run or turn the working machine" on the display unit 26 via the input/output unit 50.

Figure 18:
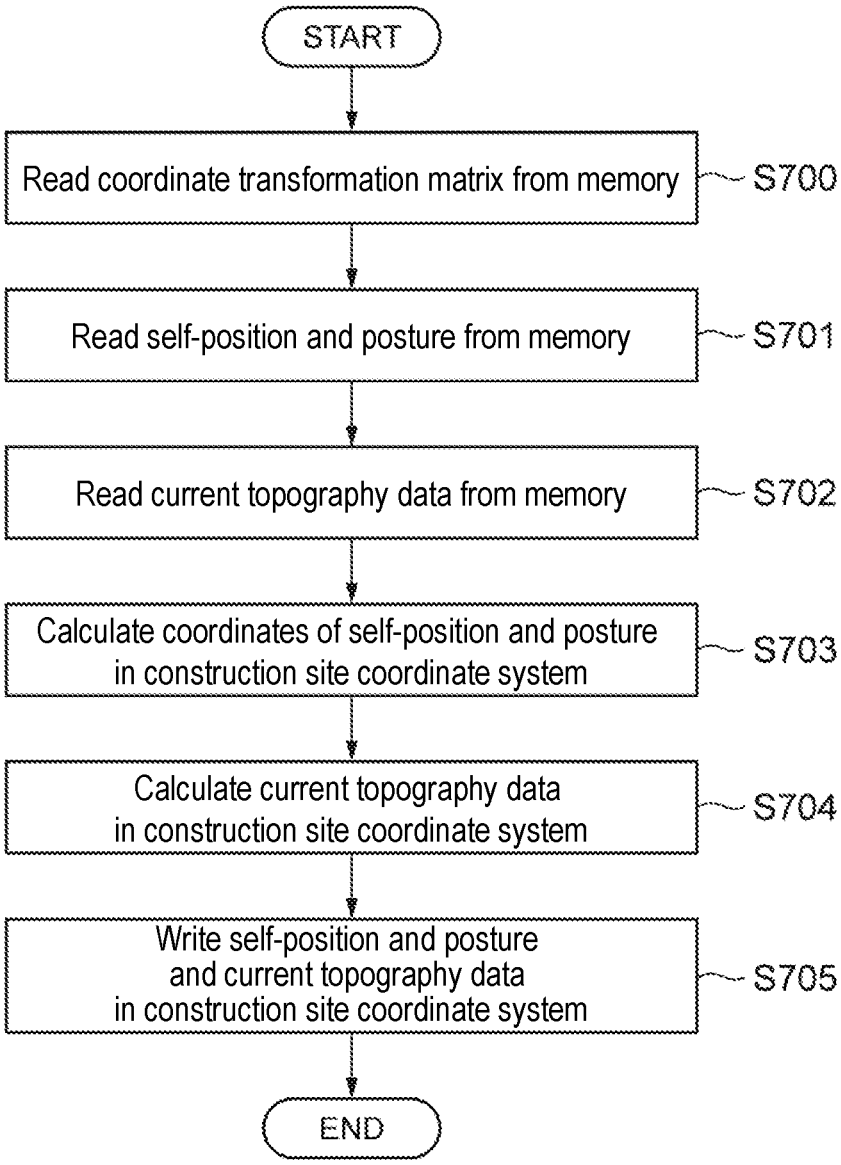
FIG. 18 is a flowchart showing the process by the controller.
Figure 19:
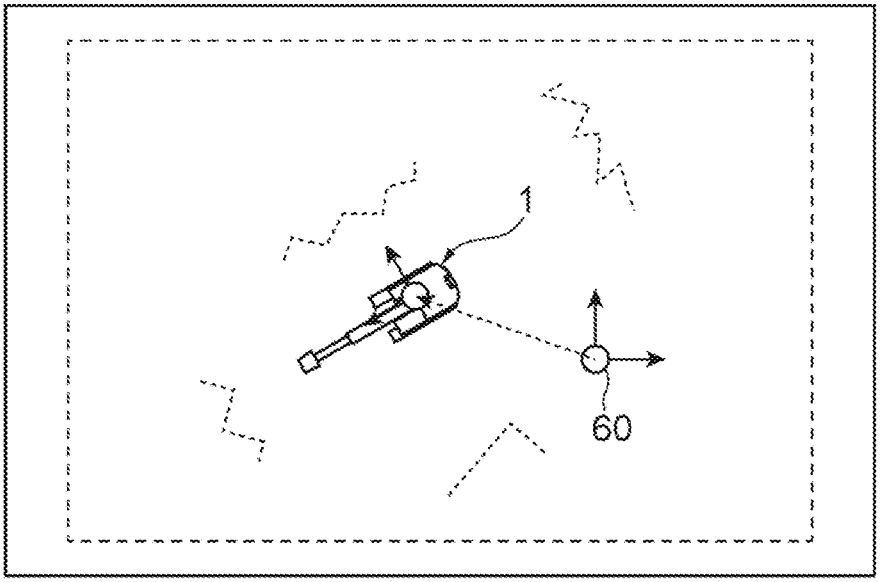
FIG. 19 schematically shows one example of coordinate transformation.
Figure 19:
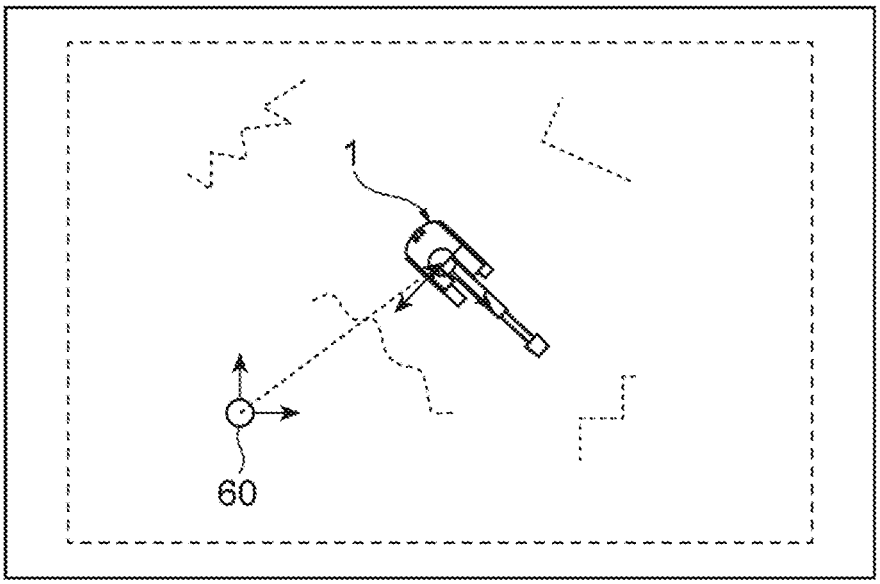

Referring next to FIG. 18 and FIG. 19, the following describes the process by the position coordinates transforming unit 51*g* of calculating coordinate values of the working machine position in the construction-site coordinate system using the coordinate transformation matrix H.

FIG. 18 is a flowchart showing the process by the position coordinates transforming unit 51*g*. As shown in FIG. 18, in step S700, the position coordinates transforming unit 51*g* reads the coordinate transformation matrix H from the memory 52. In step S701 following step S700, the position coordinates transforming unit 51*g* reads the self-position and posture in the current topography coordinate system that are estimated by the position/posture estimation unit 51*d* from the memory 52. In step S702 following step S701, the position coordinates transforming unit 51*g* reads the current topography data generated by the current topography data generator 51*c* from the memory 52.

In step S703 following step S702, the position coordinates transforming unit 51*g* calculates the coordinates P2 of the self-position and posture in the construction-site coordinate system by the following equation (6), based on the coordinate transformation matrix H read in step S700 and the coordinates P1 of the self-position and posture in the current topography coordinate system read in step S701.

$$P2 = H \times P1 \qquad \text{Equation (6)}$$

Assuming that the azimuth angle of the working machine 1 in the current topography coordinate system is θ1 and the azimuth angle of the working machine 1 in the construction-site coordinate system is θ2, the azimuth angle θ2 of the working machine 1 can be obtained by equation (7) using θ in the coordinate transformation matrix H.

$$\theta 2 = \theta 1 + \theta \qquad \text{Equation (7)}$$

In step S704 following step S703, the position coordinates transforming unit 51*g* calculates the current topography data in the construction-site coordinate system using the coordinate transformation matrix H read in step S700 and the current topography data read in step S702. For example, when the current topography data is represented by a point cloud, the position coordinates transforming unit 51*g* calculates the current topography data in the construction-site coordinate system by transforming the coordinate values of the point cloud in the current topography coordinate system with the coordinate transformation matrix H.

FIG. 19 shows an example of the current topography data and the self-position and posture in the current coordinate system calculated by the position coordinates transforming unit 51*g*. In FIG. 19, the upper part shows the current topography data generated by the current topography data generator 51*c* and the self-position and posture estimated by the position/posture estimation unit 51*d*. Transformation of coordinates using the coordinate transformation matrix H in step S703 and step S704 obtains the current topography data in the construction-site coordinate system and the self-position and posture in the construction-site coordinate system as shown in the lower part of FIG. 19.

In step S705 following step S704, the position coordinates transforming unit 51*g* writes the coordinates of the self-position and posture in the construction-site coordinate system calculated in step S703 and the current topography data in the construction-site coordinate system calculated in step S704 in the memory 52.

In the working machine 1 of the present embodiment, the processor 51 of the controller 21 includes: the peripheral area extractor 51*b* that extracts peripheral area shape data from the design data in the construction-site coordinate system; the similar shape mapping unit 51*e* that searches for and maps similar shape portions between the extracted peripheral area shape data and the current topography data in the current topography coordinate system: the coordinate transformation matrix calculator 51*f* that calculates a coordinate transformation matrix to transform from the current topography coordinate system to the construction-site coordinate system so that the difference in coordinate values of the mapped similar shape portions is minimized; and the position coordinates transforming unit 51*g* that transforms the self-position and posture of the working machine 1 and the current topography data from the coordinates of the current topography coordinate system to the coordinates of the construction-site coordinate system using the calculated coordinate transformation matrix. In this way, the present embodiment reduces the man-hours required for localization because a peripheral area whose shape is unchanged by construction is used, and the present embodiment measures the self-position and posture of the working machine 1 in the construction-site coordinate system and the surrounding topographical shape.

Second Embodiment

Referring to FIG. 20 to FIG. 24, the following describes a second embodiment of the working machine. A working machine 1A of the present embodiment is different from the first embodiment described above in that the processor 51A further has a construction area completion shape extractor 51*h* and a construction completion area extractor 51*i*. The other structure is the same as the first embodiment, and the duplicate explanations are omitted.

Figure 20:
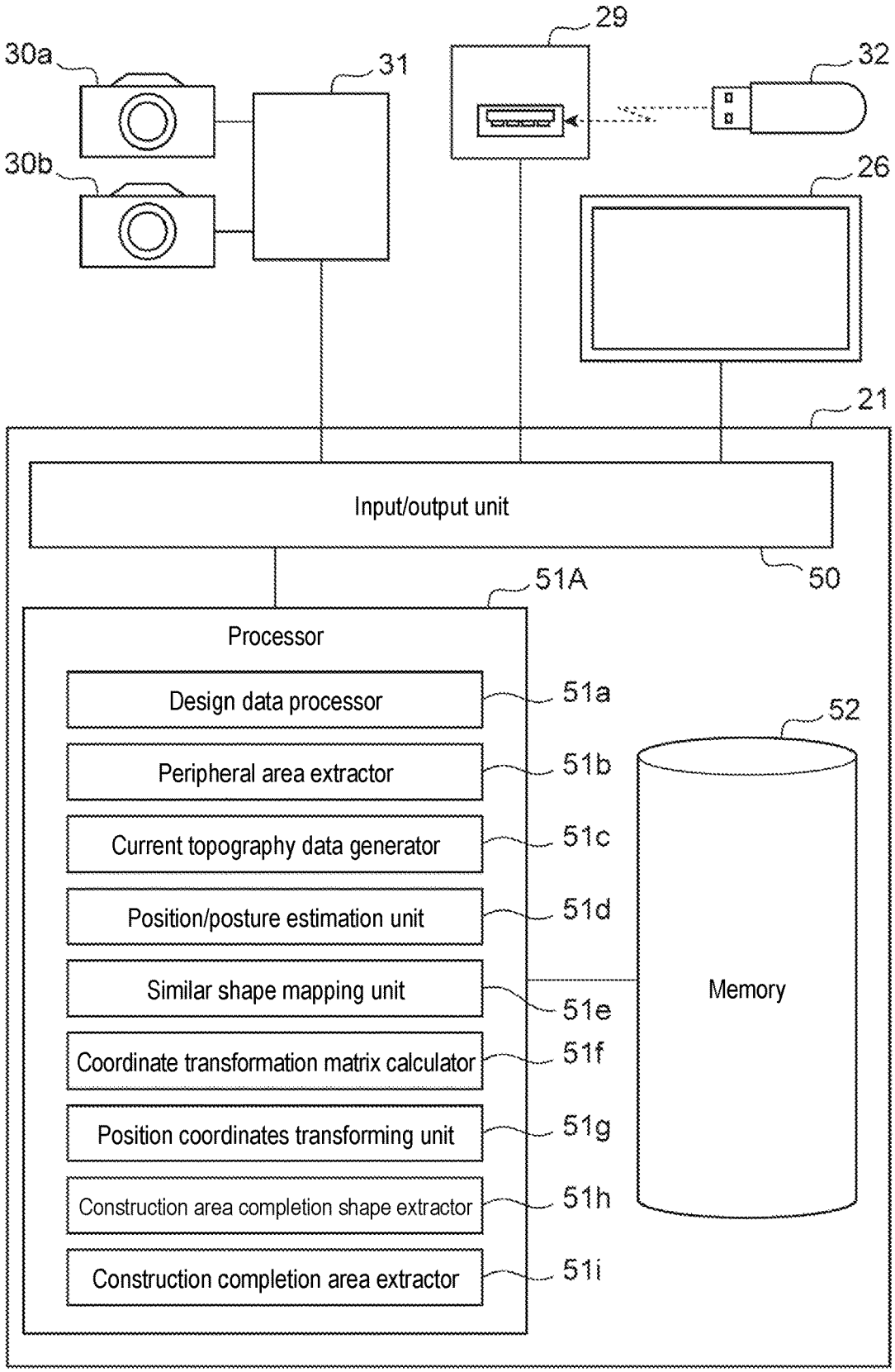
FIG. 20 is a schematic diagram of the configuration of a control system of a working machine according to a second embodiment.

FIG. 20 is a schematic diagram of the configuration of a control system of a working machine according to the second embodiment. As shown in FIG. 20, the processor 51A of the working machine 1A further has the construction area completion shape extractor 51*h* and the construction completion area extractor 51*i*.

Figure 21:
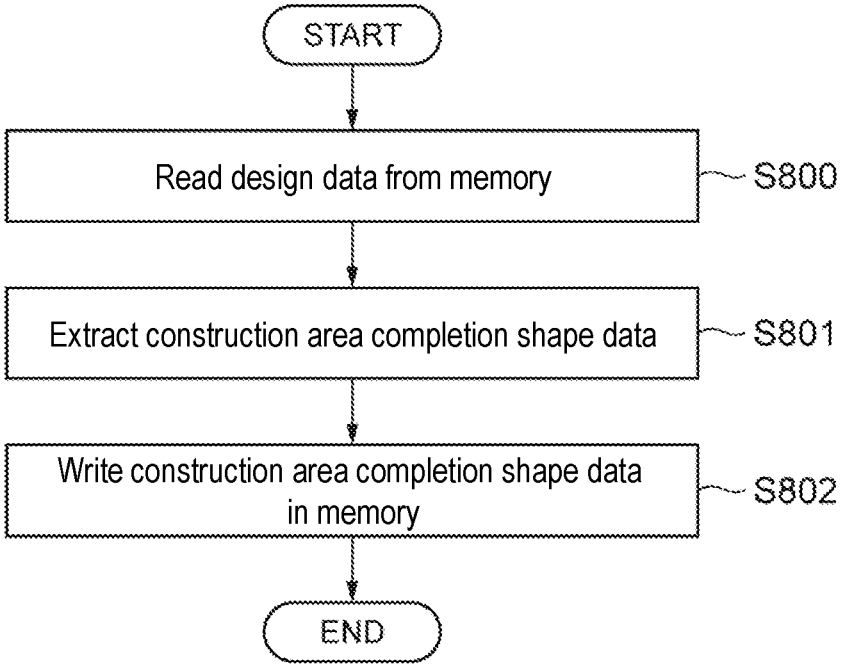
FIG. 21 is a flowchart showing the process by the controller.

Referring first to FIG. 21, the following describes of the process by the construction area completion shape extractor 51*h* of extracting the shape data after the completion of construction in the construction area from the design data.

FIG. 21 is a flowchart showing the process by the construction area completion shape extractor 51*h*. As shown in FIG. 21, in step S800, the construction area completion shape extractor 51*h* reads the design data written by the design data processor 51*a* from the memory 52. In step S801 following step S800, the construction area completion shape extractor 51*h* extracts the shape data after the completion of construction in the construction area 4 (i.e., construction area completion shape data) from the design data as shown in FIG. 6. The construction area completion shape data can be easily extracted using information on the construction boundary 3, construction area 4, and peripheral area 5 contained in the design data. The reference point of the construction area completion shape data coordinate system is the same as the reference point 60 in the design data coordinate system. The construction area completion shape data also contains information on the construction boundary 3.

In step S802 following step S801, the construction area completion shape extractor 51*h* writes the extracted construction area completion shape data in the memory 52.

Figure 22:
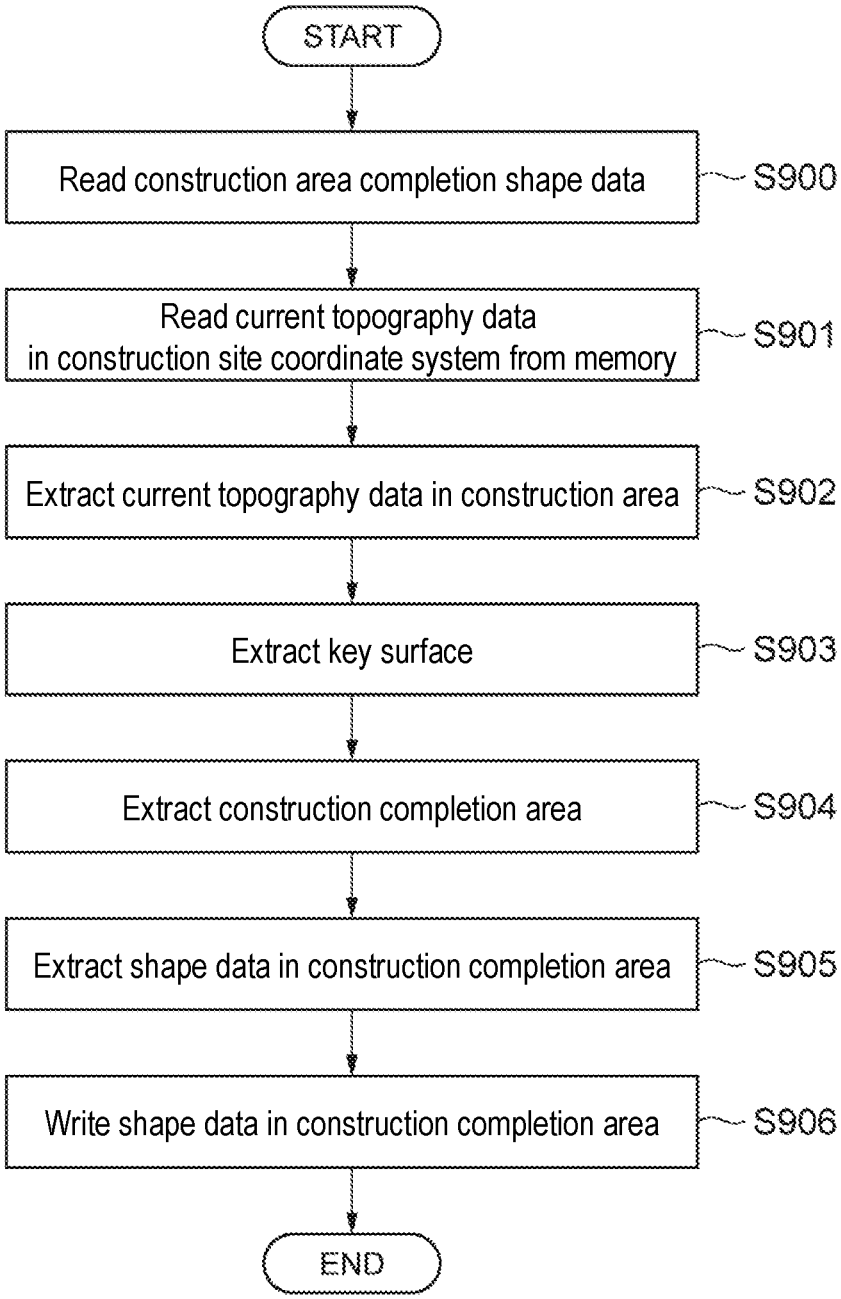
FIG. 22 is a flowchart showing the process by the controller.
Figure 23:
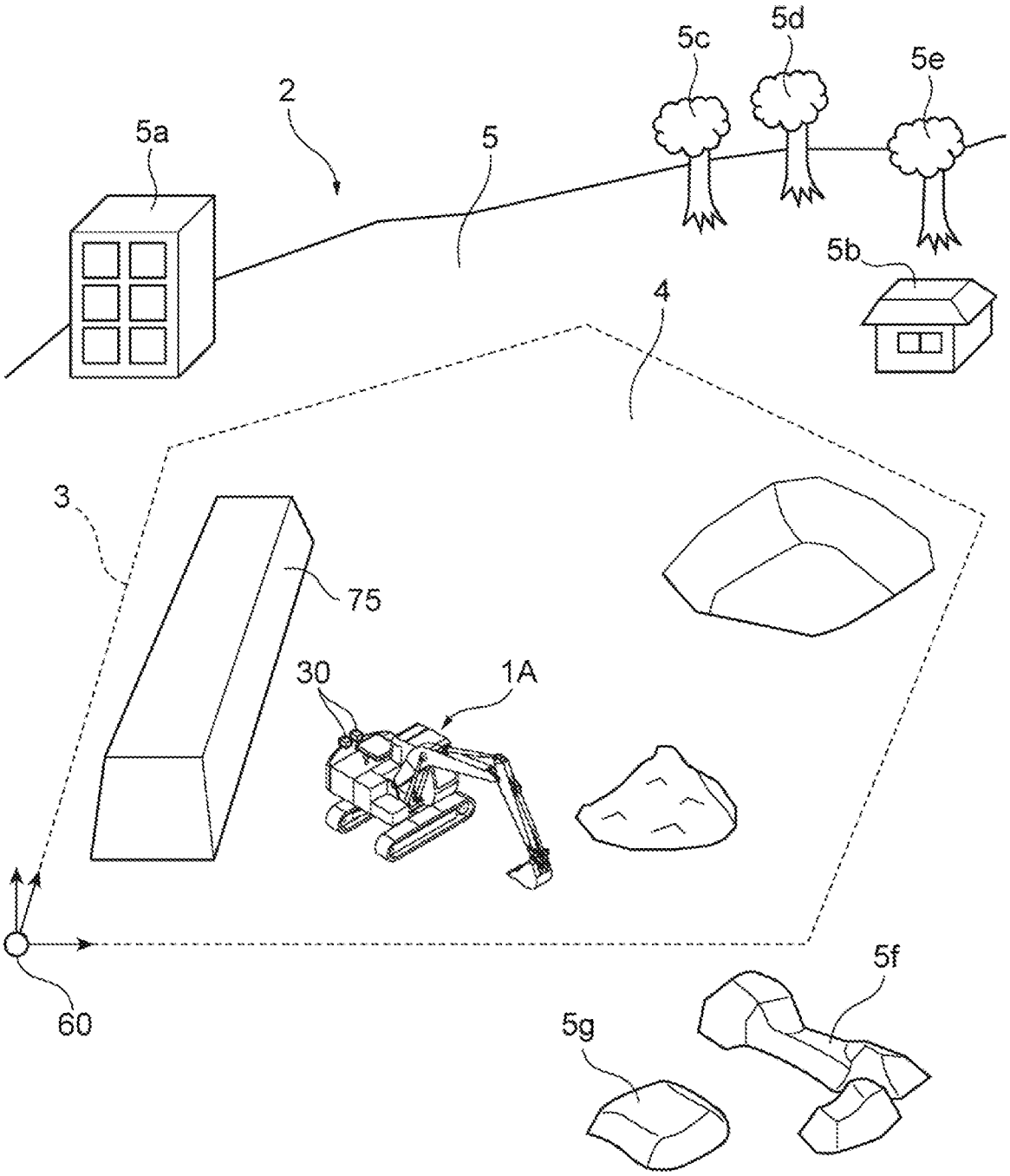
FIG. 23 schematically shows an example of extracting a construction area after the construction is completed.

Referring next to FIG. 22 and FIG. 23, the following describes of the process by the construction completion area extractor 51*i* of determining whether or not the construction is completed at a part of the construction target in the construction area 4, and extracting the area that is determined as the completion of construction.

FIG. 22 is a flowchart showing the process by the construction completion area extractor 51*i*. As shown in FIG. 22, in step S900, the construction completion area extractor 51*i* reads the construction area completion shape data written by the construction area completion shape extractor 51*h* from the memory 52. In step S901 following step S900, the construction completion area extractor 51*i* reads the current topography data in the construction-site coordinate system written by the position coordinates transforming unit 51*g* from the memory 52.

In step S902 following step S901, the construction completion area extractor 51*i* extracts the current topography data in the construction site using the data on the construction boundary 3 of the construction area completion shape data read in step S900 and the current topography data read in step S901. The coordinate system of the data on the construction boundary 3 and the coordinate system of the current topography data are the same, which allows the process to easily obtain the current topography data in the construction area.

In step S903 following step S902, the construction completion area extractor 51*i* further extracts a key surface of the construction area completion shape data read in step S900 and of the current topography data in the construction area extracted in step S902. The key surface is a surface that is determined to be a plane surrounded by the key points in the shape data, for example. When the plane extracted from the shape data using the RANdom sample consensus (RANSAC) algorithm is surrounded by key points, that plane can be obtained as the key surface.

In step S904 following step S903, the construction completion area extractor 51*i* compares the coordinate values of the key surface of the construction area completion shape data and of the key surface of the current topography data in the construction area extracted in step S903 to extract the construction completion area. For example, as shown in FIG. 23, when the topography measuring device 30 measures a slope 75 as the current topographic data at the construction site having the completed slope 75 in the construction area 4, this completed slope 75 is obtained in step S903 as the key surface of the current topographic data in the construction area.

Since the construction area completion shape data is the shape after the completion of construction, the key surface of the construction area completion shape data always includes the slope 75. For the common key surface of the construction area completion shape data and the current topography data in the construction area, the current topography can be considered as the shape after the construction is completed, which means that the common key surface can be determined as the construction completion area. The construction completion area extractor 51*i* therefore extracts the common key surface as the construction completion area.

In step S905 following step S904, the construction completion area extractor 51*i* further extracts the shape data of the construction completion area extracted in step S904. For example, the construction completion area extractor 51*i* extracts the shape data corresponding to the construction completion area from the construction area completion shape data read in step S900. The reference point of the coordinate system for the shape data of the construction completion area is the same as the reference point 60 in the design data coordinate system. In step S906 following step S905, the construction completion area extractor 51*i* writes the shape data of the construction completion area extracted in step S905 in the memory 52.

Figure 24:
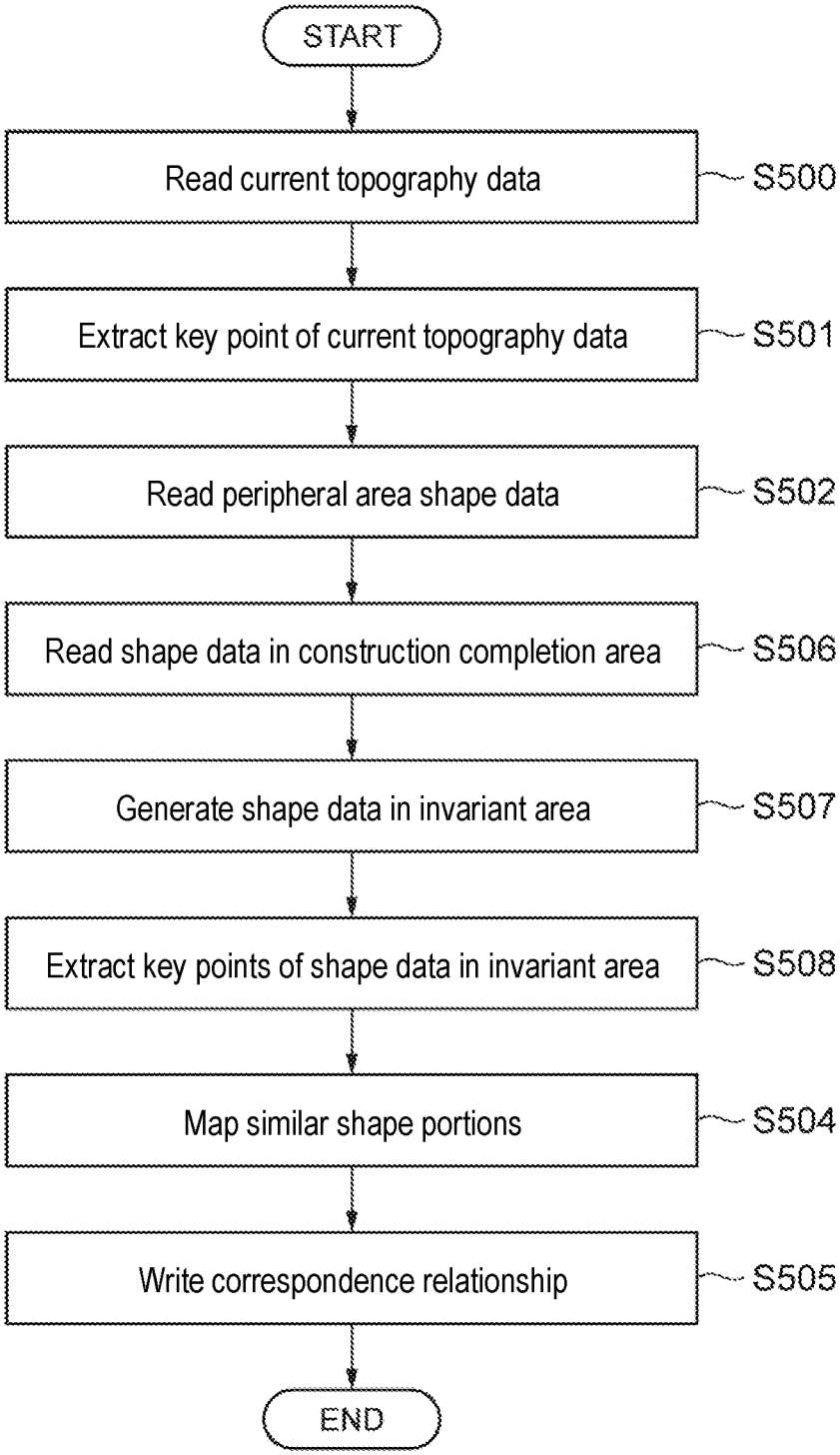
FIG. 24 is a flowchart showing the process by the controller.

In the present embodiment, the processor 51A of the working machine 1A further has the construction area completion shape extractor 51*h* and the construction completion area extractor 51*i*. The process by the similar shape mapping unit 51*e* therefore is different from the process by the similar shape mapping unit 51*e* described in the first embodiment. Specifically, as shown in FIG. 24, the process by the similar shape mapping unit 51*e* of the present embodiment includes step S506 and step S507 added between step S502 and step S503 of the flowchart of FIG. 13 in the first embodiment, and step S503 shown in FIG. 13 is replaced with step S508. The following describes only the added and replaced process.

In step S506, the similar shape mapping unit 51*e* reads the shape data of the construction completion area extracted by the construction completion area extractor 51*i* from the memory 52. In step S507 following step S506, the similar shape mapping unit 51*e* synthesizes the shape data of the construction completion area read in step S506 with the peripheral area shape data read in step S502 to create the shape data of an invariant area. The reference points of the coordinate systems for the peripheral area shape data and the shape data of the construction completion area are the same as the reference point in the construction-site coordinate system. The synthesized shape data can be easily obtained as a union of point cloud data, for example.

In step S508 following step S507, the similar shape mapping unit 51*e* extracts the key points of the shape data of the invariant area from the shape data of the invariant area created in step S507. In step S504 following step S508, the similar shape mapping unit 51*e* compares the key points of the current topography data extracted in step S501 with the key points of the shape data of the invariant area extracted in step S508 to obtain similar shape portions sequentially, and map the similar shape portions. In this way, the similar shape mapping unit 51*e* obtains the correspondence relationship between the shape data of the invariant area and the current topography data.

In step S505 following step S504, the similar shape mapping unit 51*e* writes the correspondence relationship obtained in step S504 in the memory 52.

The working machine 1A of the present embodiment determines the construction completion area and synthesizes the construction completion area with the peripheral area to be an invariant area. In this way, the present embodiment reduces the man-hours for localization, and measures the self-position and posture of the working machine in the construction-site coordinate system and the surrounding topographical shape.

Third Embodiment

Figure 25:
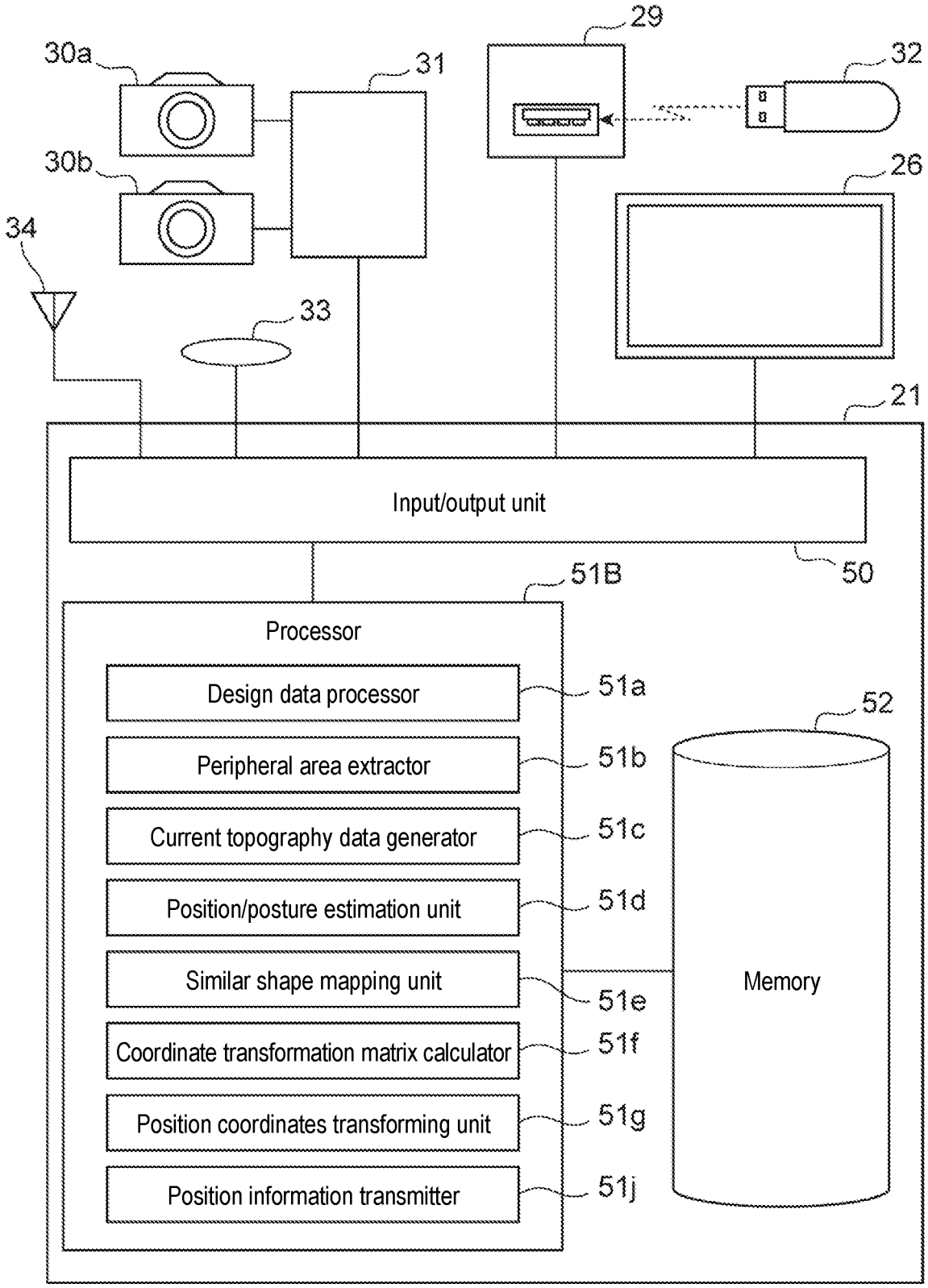
FIG. 25 is a schematic diagram of the configuration a control system of a working machine according to a third embodiment.
Figure 26:
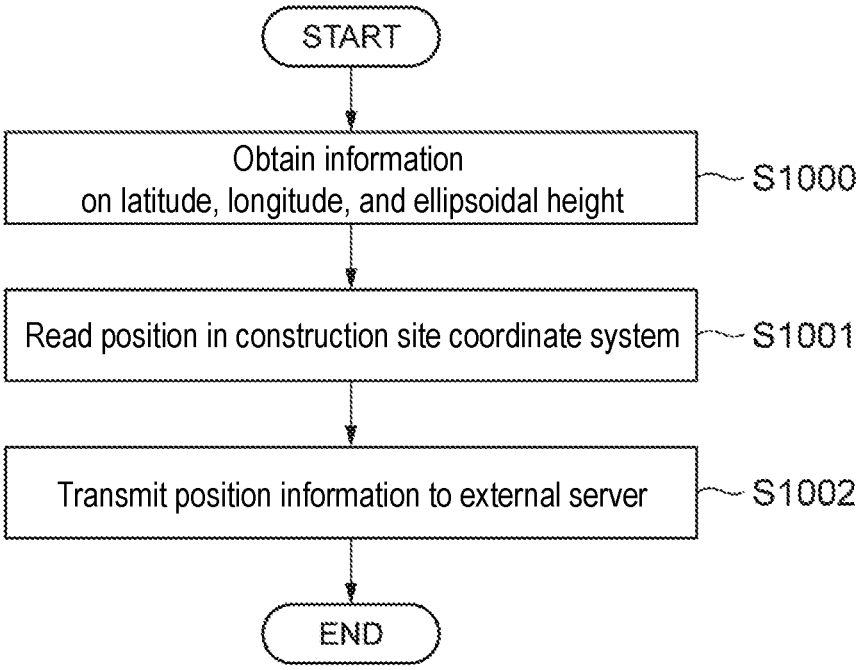
FIG. 26 is a flowchart showing the process by the controller.

Referring to FIG. 25 and FIG. 26, the following describes a third embodiment of the working machine. The working machine of the present embodiment differs from the first embodiment as described above in that it receives a signal from a positioning satellite and integrates the geographic coordinates of the latitude, longitude, and ellipsoidal height of the work machine 1 on the earth with the position coordinates of the working machine 1 in the construction-site coordinate system, and transmits the integrated position coordinates to an external server. The other structure is the same as the first embodiment, and the duplicate explanations are omitted.

FIG. 25 is a schematic diagram of the configuration a control system of a working machine according to the third embodiment. As shown in FIG. 25, the control system of the working machine according to the present embodiment has a global navigation satellite system (GNSS) antenna (position obtainment device) 33 and a wireless communication antenna (communication device) 34 in addition to the control system described in the first embodiment. In the control system, the processor 51B further includes a position information transmitter 51*j*.

FIG. 26 is a flowchart showing the process by the position information transmitter 51*j*. As shown in FIG. 26, in step S1000, the position information transmitter 51*j* obtains information on the latitude, longitude, and ellipsoidal height of the working machine 1 on the earth from the positioning satellite using the GNSS antenna 33. In step S1001 following step S1000, the position information transmitter 51*j* reads the position information on the working machine 1 (i.e., the coordinates of the self-position of the working machine 1) in the construction-site coordinate system obtained by the position coordinates transforming unit 51*g* from the memory 52.

In step S1002 following step S1001, the position information transmitter 51*j* integrates the position information obtained in step S1000 and step S1001, and transmits the latitude, longitude, ellipsoidal height and the position information on the working machine 1 in the construction-site coordinate system as a pair to an external server installed in the office of the construction site, for example, via the wireless communication antenna 34. The installation location of the external server is not limited to the construction site, which may be a cloud server.

Similarly to the first embodiment, the present embodiment reduces the man-hours for localization and measures the self-position and posture of the working machine 1 in a construction-site coordinate system and the surrounding topographical shape, and the present embodiment further transmits a plurality of pairs of latitude, longitude, ellipsoidal height and position information on the working machine 1 in the construction-site coordinate system to the external server, which obtains the correspondence relationship between the latitude, longitude, ellipsoidal height and the coordinates of the self-position in the construction-site coordinate system.

That is a detailed description of the embodiments of the present invention. The present invention is not limited to the above-stated embodiments, and the design may be modified variously without departing from the spirits of the present invention.

REFERENCE SIGNS LIST

1, 1A Working machine
10 Traveling body
11 Swing body
12 Working front
21 Controller
26 Display unit
29 Design data obtainment unit
30 Topography measuring device
30*a*, 30*b* Camera
31 Stereo camera controller
32 External storage medium
33 GNSS antenna (position obtainment device)
34 Wireless communication antenna (communication device)
50 Input/output unit
51, 51A, 51B Processor
51*a* Design data processor
51*b* Peripheral area extractor
51*c* Current topography data generator
51*d* Position/posture estimation unit
51*e* Similar shape mapping unit
51*f* Coordinate transformation matrix calculator
51*g* Position coordinates transforming unit
51*h* Construction area completion shape extractor
51*i* Construction completion area extractor
51*j* Position information transmitter

The invention claimed is:

1. A working machine comprising:

a traveling body that travels;

a swing body mounted to the traveling body to be swingable;

a working front mounted to the swing body to be rotatable;

a design data obtainment unit configured to obtain design data that has topographical data after completion of construction in the form of three-dimensional data;

a topography measuring device configured to measure surrounding topographical data in the form of three-dimensional data; and a controller having a design data processor configured to process the topographical data obtained by the design data obtainment unit as a predetermined first coordinate system design data, a current topography data generator configured to generate current topography data of a second coordinate system from the topography data measured by the topography measuring device, the second coordinate system being defined based on the installation position of the topography measuring device, and a position/posture estimation unit configured to estimate a self-position and posture in the second coordinate system based on the current topography data generated by the current topography data generator, wherein the design data in the first coordinate system includes:

construction area completion shape data that corresponds to a construction area where the working machine performs the construction; and peripheral area shape data that corresponds to a peripheral area where the working machine does not perform the construction, and wherein the controller is configured to:

map similar shape portions between the extracted peripheral area shape data and the current topography data, calculate a coordinate transformation matrix to transform from the second coordinate system to the first coordinate system so that the difference in coordinate values of the mapped shape portions is minimized, and transform the self-position and posture of the working machine and the current topography data from coordinates in the second coordinate system to coordinates in the first coordinate system using the calculated coordinate transformation matrix.

2. The working machine according to claim 1, wherein the controller compares the construction area completion shape data with the current topography data to extract a construction completion area, and in mapping the similar shape portions between the peripheral area shape data and the current topography data, maps the similar shape portions between the peripheral area shape data and the current topography data using synthesized shape data of the peripheral area shape data with shape data of the construction completion area.

3. The working machine according to claim 1, further comprising:

a position obtainment device configured to obtain position coordinates of the working machine on the earth; and a communication device configured to exchange data with an external server, wherein the controller transmits position coordinates of the working machine obtained by the position obtainment unit together with coordinates of the self-position in the first coordinate system to the external server via the communication device.

* * * * *